US007715760B2

(12) United States Patent
Sugimoto et al.

(10) Patent No.: US 7,715,760 B2
(45) Date of Patent: May 11, 2010

(54) CHARGING DEVICE, AND PROCESS CARTRIDGE AND IMAGE FORMING APPARATUS USING THE SAME

(75) Inventors: Naomi Sugimoto, Kawasaki (JP); Yukimichi Someya, Machida (JP); Sadayuki Iwai, Yokohama (JP); Katsufumi Kumano, Yokohama (JP); Eiichi Ohta, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 704 days.

(21) Appl. No.: 11/406,267

(22) Filed: Apr. 19, 2006

(65) Prior Publication Data

US 2009/0116872 A1 May 7, 2009

(30) Foreign Application Priority Data

Apr. 19, 2005 (JP) ..... 2005-120490
Sep. 2, 2005 (JP) ..... 2005-254373

(51) Int. Cl.
*G03G 15/02* (2006.01)

(52) U.S. Cl. ..... 399/168

(58) Field of Classification Search ..... 399/168–173
See application file for complete search history.

(56) References Cited

U.S. PATENT DOCUMENTS 5,864,737 A 1/1999 Obu et al.
6,728,501 B2 * 4/2004 Sano ..... 399/168

FOREIGN PATENT DOCUMENTS

| | | |
|---|---|---|
| JP | 57-178257 | 11/1982 |
| JP | 58-139156 | 8/1983 |
| JP | 58-40566 | 9/1983 |
| JP | 58-150975 | 9/1983 |
| JP | 62-52866 | 11/1987 |
| JP | 63-149669 | 6/1988 |
| JP | 2001-250467 | 9/2001 |
| JP | 2002-279885 | 9/2002 |
| JP | 2002-311684 | 10/2002 |
| JP | 2003-140444 | 5/2003 |
| JP | 3598381 | 9/2004 |
| JP | 2004-327084 | 11/2004 |

OTHER PUBLICATIONS

U.S. Appl. No. 11/693,417, filed Mar. 29, 2007, Yukimichi, et al.
Myochin et al, "Development of Corona Charger for the Reduction of the Bad Influence of Ozon on a Photoconductor", pp. 53-59. (English abstract).
Patent Abstracts of Japan—English Abstract of JP 08-106200 (JP 3119431).
U.S. Appl. No. 12/138,802, filed Jun. 13, 2008, Uno, et al.
U.S. Appl. No. 12/186,906, filed Aug. 6, 2008, Someya, et al.
U.S. Appl. No. 11/852,572, filed Sep. 10, 2007, Uda, et al.

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

A charging device including an electron discharging device for forming a latent electrostatic image on an image bearing member and containing an $sp^3$ bonding material and an electroconductive portion.

13 Claims, 13 Drawing Sheets

CHARGING DEVICE, AND PROCESS CARTRIDGE AND IMAGE FORMING APPARATUS USING THE SAME

BACKGROUND OF THE INVENTION

1. Field of the Invention

The present invention relates to a charging device, a process cartridge and an image forming apparatus, and more particularly to a charging device which charges an image bearing member by electron discharging, a corresponding process cartridge and a corresponding image forming apparatus.

2. Discussion of the Background

An image forming apparatus based on electrophotographic process is known to function as a printer, a facsimile machine, a photocopier, a plotter, and a multi-functional machine having functions of a printer, a facsimile machine and a photocopier. In this electrophotographic process, corona charging is widely adopted to uniformly charge an image bearing member to form a latent electrostatic image thereon.

This corona charging system is as follows: an electroconductive case electrode is provided around a wire electrode formed of platinum or tungsten having a diameter of from about 50 to about 200 μm or an electrode having a needle form made of a stainless material; DC or AC high voltage is applied between the electrode and the case to ionize air molecules around the electrode; and the image bearing member is charged by the ionized molecules. In this system, uniform charging can be performed from a distance.

However, in the corona charging system, air is ionized so that corona products such as ozone and nitrogen oxides are produced. The amount of the products for both of ozone and nitrogen oxides, is known to reach as high as 4 to 10 ppm after 60 minute charging.

It is known that when the density of ozone accumulated in an image forming apparatus is high, the surface of an image bearing member is oxidized, resulting in deterioration of the photosensitivity of the image bearing member and the charging power. Therefore, degraded images are obtained (refer to "Development of Corona Charger for the Reduction of the Bad Influence of Ozon on a Photoconductor" (The Imaging Society of Japan, ISJ), authored by Hisashi MYOCHIN, et. al., Vol. 31, 1, published in 1992). In addition, deterioration of devices other than an image bearing member is accelerated, resulting in problems such as short life of the devices.

Further, such nitrogen oxides cause the following problems. That is, the nitrogen oxides produce nitric acid in reaction with moisture in the air and metal nitrate in the reaction with a metal. These products have a high electric resistance in a low moisture environment but a low electric resistance in a high moisture environment when reacting with moisture in the air. Therefore, when a thin layer of nitric acid or metal nitrate is formed on the surface of an image bearing member, abnormal images such as a flowing image are obtained. This is because nitric acid or a salt thereof absorbs moisture so that the resistance of the surface of the image bearing member is low, resulting in destruction of a latent electrostatic image on the surface of the image bearing member.

Further, nitrogen oxides still accumulate in the air in the image forming apparatus without dissolving after discharging. The compound produced from the nitrogen oxides attaches to the surface of the image bearing member even when charging is not performed, that is, during idle periods of the process. Furthermore, the compound infiltrates from the surface to the inside of the image bearing member over time. This causes deterioration of the image bearing member.

In this case, the attachment on the surface of the image bearing member is removed by slightly scraping the image bearing member at a time during cleaning. However, this method involves new problems such as cost increase and deterioration over time.

In the corona charging, the applied voltage is significantly high, that is, from 4 to 10 kV, because the charging is performed from a distance. In addition, the charged voltage depends on the charging time. Therefore, when the linear velocity of an image bearing member is high, it is necessary to broaden the width of a case electrode along the rotation direction of the image bearing member. Therefore, the size reduction of an image forming apparatus having a high printing speed is difficult.

As another charging device, a charging system using a roller disposed in the vicinity of an image bearing member is now widely used. In the vicinity type roller charging, an image bearing member is charged such that an AC or DC bias is applied to between an image bearing member and a charging device (charging roller) disposed in the vicinity of the image bearing member to cause discharging in the space therebetween. In this charging system, the charging phenomenon based on Paschen's law is utilized. That is, a desired voltage is obtained by forming a voltage difference by a discharging starting voltage against the desired voltage.

In the AC bias system, the direction of the electric field formed between an image bearing member and a charging device disposed in the vicinity thereof alternates with time. Therefore, discharging and reversed discharging are repeatedly performed. Charging is evened out by discharging and reversed discharging in the AC bias system, resulting in uniform charging. However, there is a disadvantage that hazard to an image bearing member by discharging is extremely large.

The electron is provided to an image bearing member by a charging device involving Paschen discharging. As a result, hazard is inevitable. For example, products produced by discharging are attached to the surface of an image bearing member or the surface of an image bearing member is oxidized by an active air produced by discharging.

To deal with this drawback, as mentioned above, the surface of an image bearing member is minutely scraped at a time to reduce the deterioration of image quality over time. On the other hand, scraping the surface of an image bearing member is equal to attrition. It is naturally preferred to avoid such scraping from a long-term point of view. However, this scraping has a trade-off relationship with protection against image deterioration caused by the hazard to an image bearing member mentioned above. Therefore, it is difficult to find a fundamental solution to this drawback.

Further, there is another charging system, which is a contact type charging device. In this system, a charging member is brought into contact with an image bearing member to charge the image bearing member. For example, a charging member having a roller form charges an image bearing member by being driven by the image bearing member while in contact therewith. When compared with the corona charging system mentioned above, the contact type charging system has advantages such that the amount of ozone produced after 60 minute charging using DC is as small as 0.01 ppm, the applied voltage is low so that the cost of power is small and it is easy to design electric insulation.

As the contact type charging system, as described in unexamined published Japanese Patent Applications Nos. (hereinafter referred to as JOP) S57-178257, S56-104351, S58-40566, S58-139156, and S58-150975, there are methods in which discharging according to the interpretation of Paschen's law is performed at the contact portion or a narrow space formed in the vicinity thereof to charge an image bearing member. It is possible to accelerate uniform charging by applying a DC voltage not less than the charge starting voltage to an electroconductive portion or applying an oscillation voltage in which an AC voltage is overlapped with a DC voltage corresponding to the desired charging voltage, which is detailed in JOP 63-149669.

As mentioned above, when an AC voltage is applied, there is an advantage that, since the direction of electric field formed between an image bearing member and a charging device disposed in the vicinity thereof alternates with time, discharging and reversed discharging are repeatedly performed so that charging is evened out by discharging and reversed discharging. However, the amount of electric current increases. Therefore, the amount of ozone and nitrogen oxide produced increases as the electric current increases. Depending on the condition of AC application, the amount of ozone produced reaches almost 3 ppm after 60 minute charging, which is close to that in the corona charging system.

On the other hand, as described in JOP H08-106200, there is another method in which the electroconductive member mentioned above to which a voltage is applied is brought into contact with an image bearing member to infuse electrons on the surface of the image bearing member. As the electroconductive member in this method, an electroconductive member having a roller form (charging roller) is typically used in terms of easiness of controlling attachment/detachment and making a form.

However, since the charging member is formed of rubber, when, for example, a photocopier is idle for a long time, the roller, which is in contact with an image bearing member, may be transformed. In addition, since rubber is a material which easily absorbs moisture, the electric resistance thereof significantly varies according to changes in environment. Further, rubber requires several kinds of plasticizers and active agents to become elastic and prevent deterioration. Further, a dispersion helping agent is used to disperse electroconductive pigments in a considerable number of cases. That is, since the surface of an image bearing member is an amorphous resin such as polycarbonate and acryl resin, such an image bearing member is extremely weak to the plasticizers, active agents and dispersion helping agents mentioned above.

In addition, there are other problems as follows involving the contact-type charging system: when a foreign substance is nipped between a charging member and an image bearing member, the charging member is contaminated, which leads to occurrence of poor charging; and since the roller is in direct contact with an image bearing member, the image bearing member is contaminated overtime, which causes image degradation such as streak in the horizontal direction.

As a result, as a superseding technology, the system using an electron discharging material is getting attention. For example, JOP 2003-145826 describes a technology in which the electron discharging element of MIS type and MIM type is used. The electron discharging element has a structure in which an electron discharging layer formed of an insulation layer and a semiconductor material layer or metal material layer is sandwiched between a substrate electrode and a thin layer electrode.

JOP 2001-250467 describes a technology using an electron discharging element having a carbon nanotube. The peripheral part of the carbon nanotube is coated with metal or alloyed metal, or at least one compound selected from a nitride, a carbide, a silicide or a boride containing a metal.

JOP 2002-279885 describes an electron emission apparatus, a charging device and an image forming apparatus regarding an electron emission apparatus using carbon nanotube, which are capable of stable emission of electron in the atmospheric pressure and with low voltage.

JOP 2003-140444 describes a technology using an electron discharging element in which a semiconductor layer is formed between the top electrode and the bottom electrode. An organic compound absorption layer is formed so that an organic compound is absorbed in the semiconductor surface of the semiconductor layer.

Further, JOPs 2002-311684 and 2004-327084 describe technologies using an electron discharging element.

Among the electron discharging elements mentioned above, the carbon nano materials have been intensively studied. Among these, carbon nanotube has widely studied and it is suggested that carbon nanotube has a high electron discharging power. For example, JOP 2001-250467 describes that durability of carbon nanotubes can be improved by regulating the component for use in the peripheral part thereof and carbon nanotubes can be used as a contact type or non-contact type charging device.

However, there is a problem with carbon nano materials stemming from the fact that the carbon nano materials are organic compounds. That is, in the electrophotography system, electrons are discharged into the air. Therefore, carbon nano materials are oxidized by oxygen atoms excited by the discharged electron and dissolved by combustion. Carbon nanotube materials have a short life because of this structural weakness.

In addition, electron discharging elements having MIS structure and MIM structure described in JOPs 2003-145826 and 2003-140444 have a problem because the electron discharging property is not sufficient.

Because of these reasons, the present inventors recognize that a need exists for a charging device which can perform electron discharging such that corona products are not produced to prevent hazard to an image bearing member and deterioration of material discharging electrons, and a process cartridge and an image forming apparatus using the charging device.

SUMMARY OF THE INVENTION

Accordingly, an object of the present invention is to provide a charging device which can perform electron discharging such that corona products are not produced to prevent hazard to an image bearing member and deterioration of material discharging electron, and a process cartridge and an image forming apparatus using the charging device.

Briefly this object and other objects of the present invention as hereinafter described will become more readily apparent and can be attained, either individually or in combination thereof, by a charging device including an electron discharging device to form a latent electrostatic image on an image bearing member and an electroconductive portion. The electron discharging device contains $sp^3$ bonding material.

It is preferred that, in the charging device mentioned above, the $sp^3$ bonding material is $sp^3$ bonding boron nitride.

It is still further preferred that, in the charging device mentioned above, the $sp^3$ bonding boron nitride is selected from the group consisting of $sp^3$ bonding 5H-BN materials and $sp^3$ bonding 6H-BN materials. Mixtures of these materials may be used.

It is still further preferred that, in the charging device mentioned above, a voltage is applied between the image bearing member and the electron discharging device containing the $sp^3$ bonding material to discharge electrons from the surface of the $sp^3$ bonding material and the image bearing member is charged by the electrons or ions generated when the electrons are attached to air molecules.

It is still further preferred that, in the charging device mentioned above, the voltage applied between the electron discharging device containing the $sp^3$ bonding material and the image bearing member is not greater than a discharging limit determined by Paschen's law.

It is still further preferred that, in the charging device mentioned above, the electron discharging device containing the $sp^3$ bonding material is disposed opposing the surface of the image bearing member with a gap not less than 20 μm.

It is still further preferred that, in the charging device mentioned above, the electron discharging device containing the $sp^3$ bonding material is disposed opposing the surface of the image bearing member with a gap not less than 50 μm.

It is still further preferred that, in the charging device mentioned above, the electron discharging device containing the $sp^3$ bonding material further includes an electroconductive member which is configured to control the voltage of the surface of the image bearing member and disposed between the electron discharging device containing the $sp^3$ bonding material and the image bearing member.

It is still further preferred that, in the charging device mentioned above, the electron discharging device containing the $sp^3$ bonding material is a thin layer having a thickness not greater than 100 μm formed on the electroconductive portion.

It is still further preferred that, in the charging device mentioned above, the electron discharging device containing the $sp^3$ bonding material is formed such that powder of the $sp^3$ bonding material is fixed on the electroconductive portion by electroconductively contacting the electroconductive portion.

As another aspect of the present invention, an image forming apparatus is provided which includes an image bearing member, the charging device mentioned above to charge the image bearing member to form a latent electrostatic image on the image bearing member, a developing device to develop the latent electrostatic image and a transfer device to transfer the developed image to a transfer material.

It is preferred that, in the image forming apparatus, the charging device includes a plurality of independent charging elements and a voltage supplying device is provided such that it is possible to independently set and apply a voltage to each of the plural of independent charging units.

It is still further preferred that, in the image forming apparatus, the voltage supplying device applies a controlled voltage such that each charging unit can supply the same amount of charge to the image bearing member.

As another aspect of the present invention, a process cartridge is provided which includes an image bearing member, the charging device mentioned above and at least one device selected from the group consisting of a developing device, a transfer device and a cleaning device. The process cartridge is detachably attached to the main body of an image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

Figure 1:
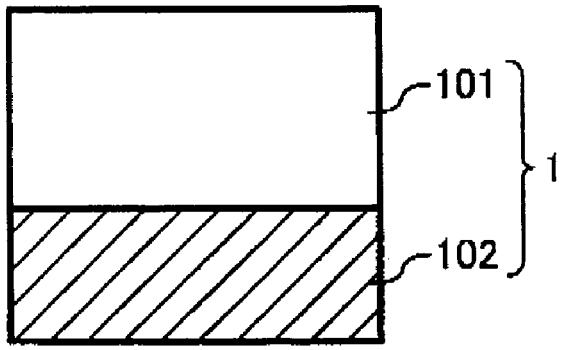
FIG. 1 is a diagram illustrating an example of the electron discharging element for use in the charging device of the present invention.
Figure 2:
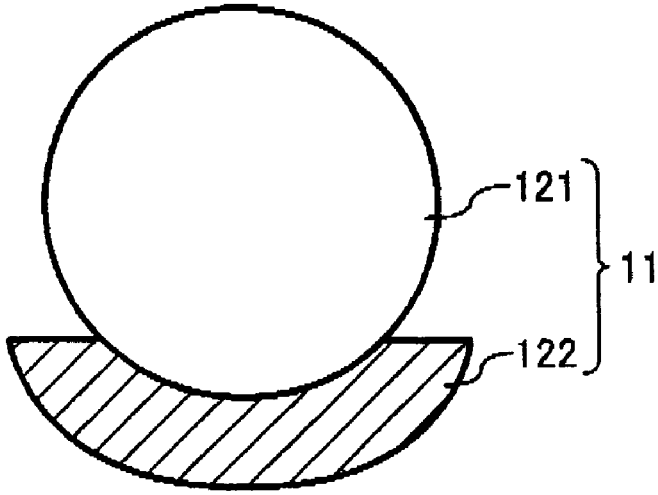
FIG. 2 is a diagram illustrating another example of the electron discharging element.

First, an electron discharging element functioning as electron discharging device forming the charging device of the present invention is described with reference to FIGS. 1 and 2. FIG. 1 is a diagram illustrating an example of the electron discharging element and FIG. 2 is a diagram illustrating another example of the electron discharging element.

Electron discharging element 1 illustrated in FIG. 1 is formed by fixing a thin layer 102 of $sp^3$ bonding material on an electrode 101. Electron discharging element 11 illustrated in FIG. 2 is formed by dispersing and fixing powder 122 containing $sp^3$ bonding material on an electrode 121.

These electron discharging elements 1 and 11 discharge electrons when a voltage is applied to the electrodes 101 and 121 by a power supply (not shown). The discharged electrons generate negative ions by attaching to air molecules such as oxygen molecules, carbon dioxide molecules, nitrogen molecules and molecules thereof to which water is attached. The negative ions charge a body to be charged.

How the amount of ozone and nitrogen oxides produced during discharging is reduced when the electron discharging elements 1 and 11 are used is described.

In general, an extremely large amount of ozone and nitrogen oxides (NOx) is produced when charging is performed by corona charging. This is because the energy of the electron discharged by a corona wire is not less than 30 eV, which is greater than the dissociation energy of nitrogen molecules on electron collision, i.e., 24.3 eV, and the dissociation energy of oxygen molecules on electron collision, i.e., 8 eV. As a result, air molecules are dissociated by this electron collision therebetween.

On the other hand, the energy of the electron generated by an electron discharging element using an $sp^3$ bonding material is about 6 eV, which is not sufficient to dissociate air molecules. Consequently, nitrogen oxides and ozone are not produced.

That is, since corona products (ozone and NOx) are not produced, the electron discharging element using an $sp^3$ bonding material does not cause hazard to an image bearing member such as attachment of corona products to the surface of the image bearing member and oxidation thereof causing deterioration. The electron discharging material used in the electron discharging element is free from deterioration caused by combustion deriving from oxidation. Therefore, the charging can be stably performed for an extended period of time. In addition, it is possible to obtain a charging voltage sufficient for a body to be charged in a short time even with a low voltage operation. Further, since the system of electron discharging element using an $sp^3$ bonding material is non-contact type charging, the system is free from deterioration caused by attachment of the toner remaining on an image bearing member after transfer.

Next, the $sp^3$ bonding material is described. Specific examples of the $sp^3$ bonding materials include $sp^3$ bonding boron nitrides, for example, $sp^3$ bonding 5H-BN materials or $sp^3$ bonding 6H-BN materials or mixtures thereof. These are compounds represented by chemical formula of BN and having hexagonal system 5H type or 6H type multi-angular structure. Specifically, the compound described in Japanese Patent No. (hereinafter referred to as JPP) 3598381 is well known.

As a result of the intensive study on application of such $sp^3$ bonding 5H-BN materials or $sp^3$ bonding 6H-BN materials to a charging device included in an image bearing member in an image forming apparatus, it is found that it is possible to charge an image bearing member by using $sp^3$ bonding 5H-BN materials or $sp^3$ bonding 6H-BN materials as electron discharging materials. The present invention was thus made.

Especially, $sp^3$ bonding 5H-BN materials have the same bonding state as that of diamond and is one of the boron nitrides which is hardest next to diamond. For example, boron nitrides are used to manufacture a crucible. Boron nitrides have excellent thermal resistance and chemical resistance. Therefore, it can be said that boron nitrides are an electron discharging material having a non-conventional durability and a good resistance to high load.

These $sp^3$ bonding 5H-BN materials can be manufactured by irradiating a substrate made of silicon, nickel, etc., with a mixed gas plasma (diboran: boron hydride ($B_2H_6$), hydrogen, ammonium and argon) together with defocused (slightly concentrated) ultraviolet excimer laser (λ: 193 nm, f: 1030 Hz). In this method, a thin layer of $sp^3$ bonding 5H-BN is formed and the surface thereof has projections having sharp spindle forms having a length of about 10 μm along with the laser irradiation direction, which function as an electron discharging emitter.

When such an electron discharging element using such $sp^3$ bonding material is manufactured, the $sp^3$ bonding material thin layer as mentioned above is formed as the surface layer on the electroconductive material (the electrode mentioned above). Therefore, it is possible to make the manufacturing time short while keeping the electron discharging property and reduce cost while limiting the material cost when compared with single crystals. It is also possible to simplify the manufacturing process and reduce cost when a powdered $sp^3$ bonding material fixed by electroconductively contacting with an electrode, i.e., electroconductive portion, is used in comparison with a single crystal $sp^3$ bonding material.

Figure 3A:
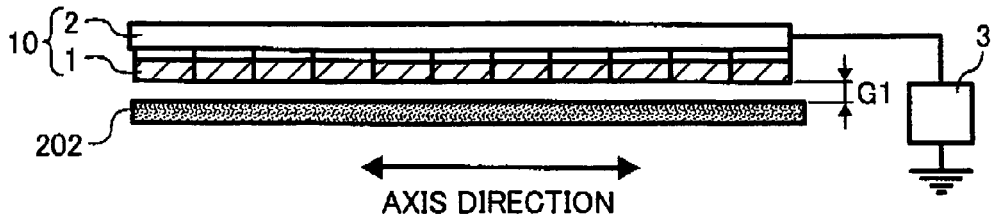
FIG. 3 are diagrams illustrating an embodiment of the charging device of the present invention along the axis direction of an image bearing member.
Figure 3B:
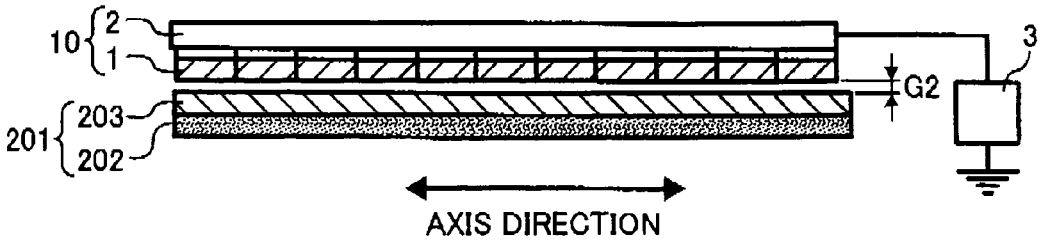

Next, an embodiment of the charging device of the present invention having such an electron charging element is described with reference to FIG. 3. FIGS. 3A and 3B are diagrams illustrating the embodiment along the axis direction of an image bearing member.

This charging device has a structure in which a plurality of the electron discharging elements 1 (i.e., charging element) are arranged on an electrode 2 formed of, for example, aluminum, without a space. The electron discharging elements 1 are fixedly attached to the electrode 2 with an electroconductive adhesive to form an electron discharging array 10. A DC power supply 3 applies a voltage to the electron discharging array 10.

To be specific, as mentioned above, the electrode (electroconductive material) 101 (refer to FIG. 1) formed of silicone, nickel, etc., having cross section of 10 mm×5 mm with a thickness of 500 μm is irradiated with a mixed gas plasma (diboran: boron hydride (B2H6), hydrogen, ammonium and argon) together with defocused (slightly concentrated) ultraviolet excimer laser (λ: 193 nm, f: 1030 Hz). As a result, the thin layer 102 (refer to FIG. 1) of $sp^3$ bonding 5H-BN is formed on the electrode 101 as the electron discharging elements 1.

An image bearing member 201 serving as a body to be charged by this charging device includes an electroconductive substrate 202 and a photosensitive layer 203.

First, the following experiment is performed using an aluminum tube as the electroconductive substrate 202 without the photosensitive layer 203; a voltage is applied to the electron discharging element array 10 and the current amount is measured. The current amount is converted into the amount of electron to obtain the theoretical value of the surface charging voltage of an image bearing member.

A voltage is applied to the electron discharging array 10 under the following condition: A gap G1 between the electron discharging array 10 and the electroconductive substrate 202 is maintained to be 20 μm; the electroconductive substrate 202 is not in motion; the electron discharging array 10 is fixed and the width thereof is 5 mm. When −20 V is applied from the power supply 3 to the electron discharging array 10 and the current amount flowing in the electroconductive substrate 202 is measured, it is confirmed that the current amount is sufficient to charge the surface of the image bearing member 201 to be −600 V.

Consequently, this charging device is confirmed to have a sufficient charging ability with a relatively extremely low voltage (|20| V in this case) in comparison with a typical charging device.

In addition, a voltage is applied to the electron discharging array 10 while the gap G1 between the electron discharging array 10 and electroconductive substrate 202 is maintained to be 50 μm. When −50 V is applied from the power supply 3 to the electron discharging array 10 and the current amount flowing in the electroconductive substrate 202 is measured, it is confirmed that the current amount is sufficient to charge the surface of the image bearing member 201 (i.e., the electroconductive substrate 202) to be −600 V. Further, when the gap G1 is changed to 100 μm and the power supply 3 applies −100 V, it is confirmed that the current amount is sufficient to charge the surface of the image bearing member 201 (the electroconductive substrate 202) to be −100 V.

To evaluate the ability of charging an image bearing member, anon-contact type charging is performed under the following conditions: a gap G2 between the electron discharging array 10 and the image bearing member 201 (i.e., the photosensitive layer 203) is maintained to be 20 μm; the linear velocity of the image bearing member 201 is 200 mm/sec; and the electron discharging array 10 is fixed and the width thereof is 5 mm. When −300 V is applied from the power supply 3 to the electron discharging array 10 and the current amount flowing in the electroconductive substrate 202 is measured, it is confirmed that the current amount is sufficient to charge the surface of the image bearing member 201 to be −200 V.

The reason the voltage applied to the electron discharging array 10 is set to be −300 V is to prevent discharging by setting a voltage sufficiently lower than the discharging limit voltage of −436V obtained based on Paschen's law when the gap G2 is 20 μm.

Similarly, another non-contact type charging is performed by changing the gap G2 between the electron discharging array 10 and the image bearing member 201 (i.e., the photosensitive layer 203) to 50 μm. When −300 V is applied from the power supply 3 to the electron discharging array 10, the surface voltage of the image bearing member 201 is confirmed to reach −100 V. Further, another similar non-contact type charging is performed by fixing the gap G2 to be 100 μm. When −300 V is applied, the surface voltage of the image bearing member 201 is confirmed to reach −50 V.

Judging from the results, when the electron discharging array 10 is used as a charging device to charge the image bearing member 201, it is confirmed that it is possible to charge the image bearing member 201 with an extremely low voltage in comparison with the case of a typical charging device. The reason the surface charging voltage of the image bearing member 201 does not reach the voltage applied to the electron discharging array 10 as calculated based on the theoretical value is inferred to be that since the photosensitive layer 203 of the image bearing member 201 is insulative, the intensity of the electric field required to discharge electrons is hard to obtain.

In addition, it is confirmed that, as the gap G2 increases, it is harder for the discharged electrons from the electron discharging element 1 to reach the image bearing member 201. Therefore, to obtain a sufficient charging voltage, it is preferred to provide a grid which accelerates the discharged electrons so that the electrons can reach the image bearing member 201 when the gap G is wide.

The voltage applied to the electron discharging element 1 is set such that the voltage difference between the $sp^3$ bonding material and the surface of the image bearing member is the voltage difference not greater than the discharging limit based on Paschen's law. Thereby, it is possible to prevent production of ozone and NOx by electrolytic dissociation of air molecules caused by discharging. Further, it is possible to control the charging voltage by preventing the occurrence of Paschen discharging and elongate the life of $sp^3$ bonding material.

As mentioned above, the gap between the $sp^3$ bonding material and the surface of the image bearing member is set to be not less than 20 μm and preferably not less than 50 μm. Thereby, an allowance for wobbling of an image bearing member and the diameter of a carrier for use in a two component developer is secured. As a result, the electron discharging element is free from scars caused by the contact between the electron discharging element 1 and foreign objects or an image bearing member. Therefore, life of the $sp^3$ bonding material is elongated.

Figure 4:
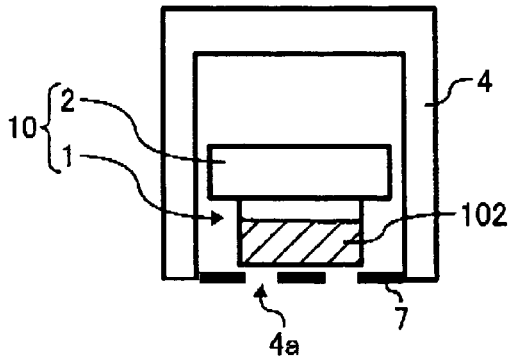
FIG. 4 is a diagram illustrating a lateral side of an electron discharging array for describing an embodiment of the charging device of the present invention.
Figure 5:
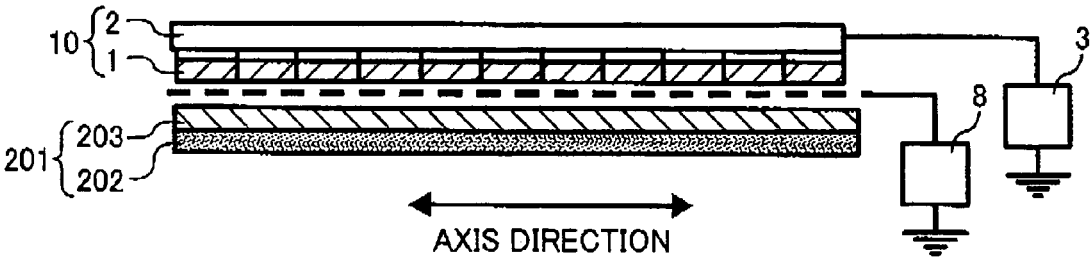
FIG. 5 is a diagram illustrating another embodiment of the charging device of the present invention along the axis direction of an image bearing member.

Next, another embodiment of the charging device of the present invention is described with reference to FIGS. 4 and 5. FIG. 4 is a diagram illustrating a lateral side of the charging device in the embodiment and FIG. 5 is a diagram illustrating the embodiment along with the axis direction of the image bearing member.

In this embodiment, the electron discharging array 10 in the embodiment mentioned above is placed in a case 4 having insulation property and three sides with an opening mouth 4*a*. A grid 7 made of stainless metal is attached to the opening mouth 4*a* of the case 4 and a power supply 8 applies a voltage to the grid 7.

As the grid 7, a stainless plate having a honeycomb structure typically adopted in scorotron charging system is used. An electroconductive film through which electrons passes and an electroconductive plate material having holes through which electrons pass can be used.

A non-contact type charging is performed as follows: the distance between the electron discharging array 10 and the grid 7 is set to be 50 μm, and the gap between the grid 7 and the image bearing member 201 is set to be 1 mm; the power supply 3 applies −300 V to the electron discharging array 10 and the power supply 8 applies −650 V to the grid 7; and the opening mouth 4*a* of the case 4 is disposed opposing the image bearing member 201.

When the linear velocity of the image bearing member 201 is 200 mm/sec, the voltage of the surface of the image bearing member 201 is −600 V. When the applied voltage to the grid 7 is changed, the surface voltage of the image bearing member 201 also varies. When −850 V is applied to the grid 7, the surface voltage of the image bearing member is about −800 V. In addition, it is confirmed that, when the applied voltage to the grid 7 is reduced, the surface voltage of the image bearing member 201 decreases correspondingly.

As described above, by providing an electroconductive material (grid) in the gap between the $sp^3$ bonding material and the surface of the image bearing member to control the surface voltage of an image bearing member, a desired voltage can be obtained even when the gap between the $sp^3$ bonding material and the surface of the image bearing member is wide. Thereby, it is possible to perform electron discharging from a distance. Therefore, it is possible to prevent the contamination caused by toner, etc., securely apply the charging voltage, prevent scars caused by contact between the charging member (electron discharging elements) and foreign objects or an image bearing member, and elongate life of the $sp^3$ bonding material.

Figure 6:
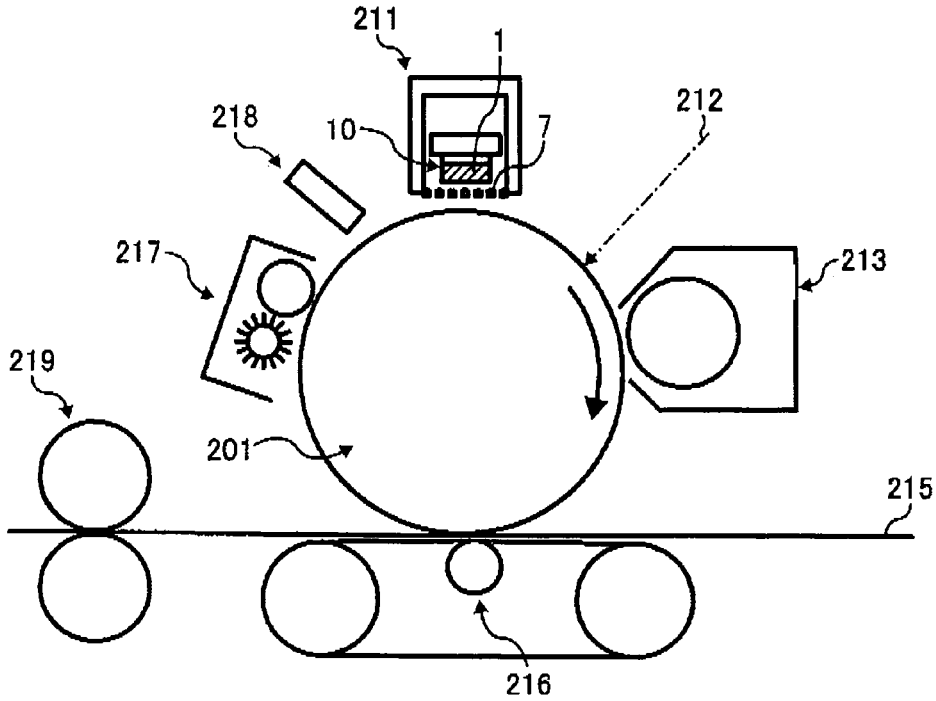
FIG. 6 is a diagram illustrating an embodiment of the image forming apparatus of the present invention.

Next, an embodiment of the image forming apparatus having the charging device of the present invention is described with reference to FIG. 6. FIG. 6 is a diagram illustrating the image forming apparatus.

This image forming apparatus has an image bearing member 201 and the image bearing member 201 rotates in the direction indicated by the arrow and has a drum form. Around the image bearing member 201, there are provided the charging device 211 as described in the second mentioned embodiment having the electron discharging array 10 to charge the surface of the image bearing member 201, a developing device 213 to develop a latent electrostatic image formed on the charged image bearing member 201 according to the document image by irradiation of a laser beam 212, a transfer device 216 to transfer the toner image on the image bearing member 201 to a transfer material 215, a cleaning device 317 to remove the toner remaining on the image bearing member 201 after transfer, and a discharging device 218 to remove the residual charge on the image bearing member 201. In addition, a fixing device 219 to fix the toner image transferred onto the transfer material 215 is also provided.

When the distance (gap G) between the electron discharging array 10 of the charging device 211 and the surface of the image bearing member 201 is set to be 50 μm and −560 V is applied to the electron discharging array 10, the electrons discharged from the electron discharging array 10 are attached to the image bearing member 201 so that the surface thereof is charged. The image bearing member 201 rotates at 200 mm/sec after charging. A writing device (not shown) forms a latent electrostatic image. Thereafter, the developing device visualizes the latent electrostatic image with a developer such as toner. The toner image formed on the image bearing member 201 is transferred to the transfer material 215 by the transfer device 216. A subtle amount of toner remains on the image bearing member 201 after the toner image is transferred. The cleaning device 317 removes the remaining toner. Next, the image bearing member 201 is discharged by the discharging device 218 to be ready for the next image formation.

A structure without a cleaning device in which remaining toner is retrieved by a developing device is also allowed.

The charging device of the present invention having the electron discharging array can charge an image bearing member without producing ozone and NOx as mentioned above. In addition, since the applied voltage by this system can be relatively small in comparison with the case of corona charging and roller type charging, an image forming apparatus using this charging device can save energy. Further, since the electron discharging is performed with a low energy, organic materials such as polycarbonate for use in forming an image bearing member are not oxidized and combusted. As a result, it is possible to reduce the amount of scraping of the image bearing member.

Next, another embodiment of the image forming apparatus of the present invention for use in directly forming a latent electrostatic image by the electron discharging element is described.

The electron discharging elements 1 are arranged over the length of, for example, 300 mm, in the axis direction of an image bearing member with a density of, for example, 600 dpi. Each electron discharging element 1 is structured to be independently charged.

When a print signal is provided, a voltage is applied to each electron discharging element 1 according to the writing signal based on the image. Among all of the electron discharging elements 1, electrons are discharged from only the electron discharging elements 1 to which the voltage has been applied. The area on the image bearing member disposed opposing the electron discharging elements 1 is charged by the discharged electrons. The area corresponding to the electron discharging elements 1 to which the voltage has not been applied is not charged. Therefore, charged portions and non-charge portions are formed on the image bearing member, which form a latent electrostatic image. That is, a charging device having the electron discharging elements 1 also functions as a writing device for writing a latent image on an image bearing member.

Thereafter, the latent image is developed with, for example, toner, and a corresponding visualized image is formed. The toner image formed on the image bearing member is transferred to a transfer material such as paper by a transfer device. A subtle amount of toner remains on the image bearing member after the toner image is transferred. The remaining toner is removed in the next process, i.e., the cleaning process. Next, the image bearing member is discharged by the discharging device to be ready for the next image forming. A structure without a cleaning device in which remaining toner is retrieved by a developing device is also allowed.

As described above, in the system in which latent images are directly formed, the size and cost of an image forming apparatus can be reduced because typical two processes, i.e., charging and irradiation processes, can be simplified at a time. In this case, the charging device and the irradiating device function as a charge imparting device.

That is, when an image forming apparatus has a plurality of independent charging devices (electron discharging elements using $sp^3$ bonding materials) which can apply a voltage and a charge application device which can independently set and apply a voltage to the plural of charging devices, it is possible to charge or non-charge a dot on an image bearing member and directly form a desired latent image on the image bearing member during charging. Thereby, an irradiating device for forming a latent image on an image bearing member having photoconductivity is made redundant, which leads to cost reduction of an image forming apparatus.

It is preferred to provide a voltage application device which can apply a controlled voltage to the plural of charging elements in a charging device so that each of the plural of charging devices can supply the same amount of charge to an image bearing member. When a latent image is directly formed by multiple minute charging devices (elements) during charging, quality images are not obtained without the uniform voltage. Therefore, to obtain quality images, it is desired to control the amount of charge supplied from each charging device (element) which charges an area corresponding to one pigment to be the same.

Figure 7:
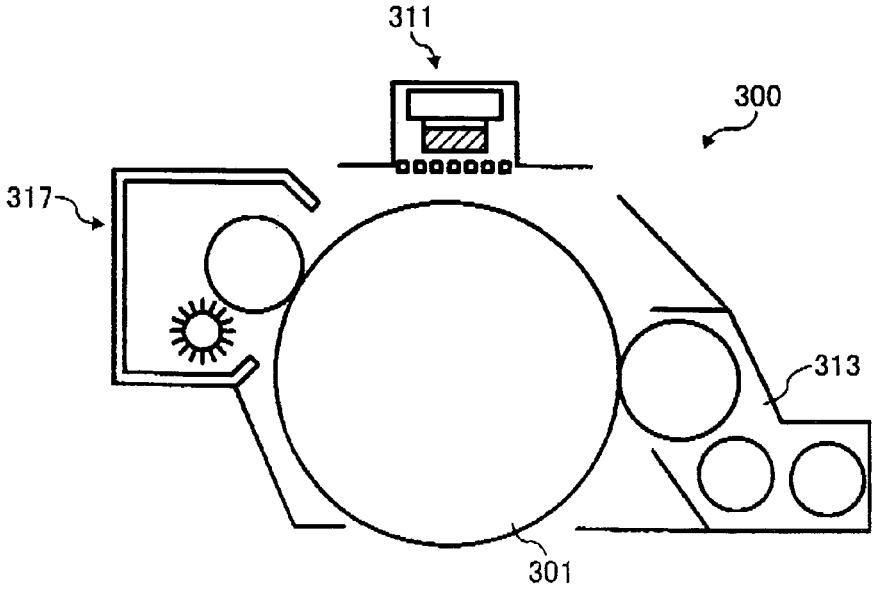
FIG. 7 is a diagram illustrating an example of the process cartridge of the present invention.

Next, the process cartridge of the present invention having the charging device of the present invention is described with reference to FIG. 7. FIG. 7 is a diagram illustrating the process cartridge.

A process cartridge 300 has a structure in which an image bearing member 301, a charging device 311 serving as the charging device of the present invention, a developing device 313, and a cleaning device 217 are integrally combined as a process cartridge. This process cartridge is detachably attached to the main body of an image forming apparatus such as a photocopier and a printer. The process cartridge of the present invention is not limited to this structure but, for example, can have a structure having the charging device, the image bearing member 301, and at least one of the developing device 313 and the cleaning device 217.

By providing the charging device 311 to the process cartridge detachably attachable to the main body of an image forming apparatus, maintenance property is improved and the process cartridge can be easily replaced.

Figure 8:
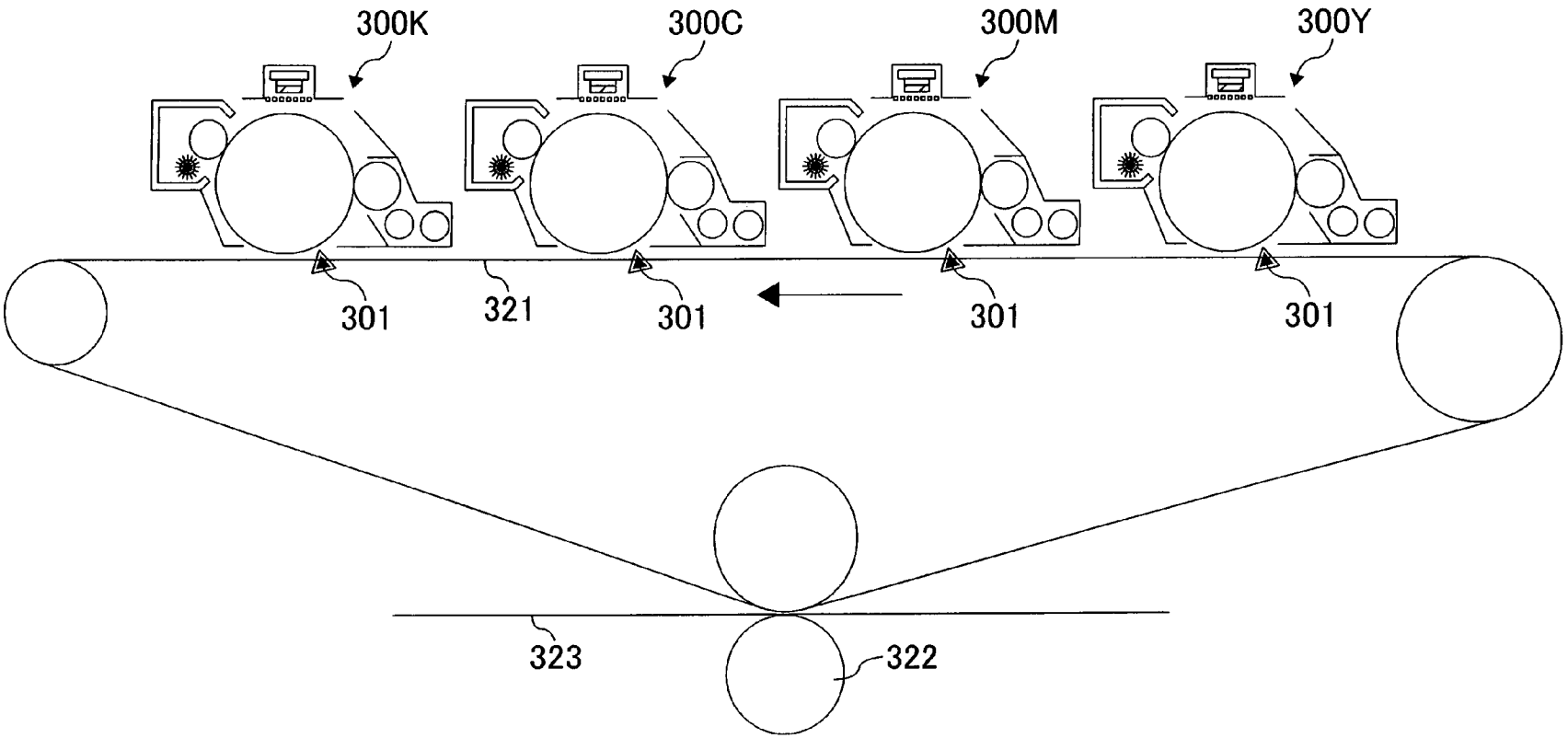
FIG. 8 is a diagram illustrating an example of the image forming apparatus having the process cartridge of the present invention.

Next, a color image forming apparatus using the process cartridge of the present invention is described with reference to FIG. 8. FIG. 8 is a diagram illustrating the image forming apparatus.

This image forming apparatus is a color image forming apparatus having a transfer belt 321 extending in the horizontal direction along which the above-mentioned process cartridges 300Y, 300M, 300C and 300K are arranged side by side to form each color image of yellow, magenta, cyan and black. The toner images developed on each image bearing member 301 in each process cartridge 300Y, 300M, 300C, 300K are transferred accordingly to the transfer belt 321 extending in the horizontal direction to which a transfer voltage is applied.

Images of yellow, magenta, cyan and black are formed, overlapped on the transfer belt 321 and transferred to a transfer material 323 by a transfer device 322 at one time. The overlapped toner image on the transfer material 323 is fixed by a fixing device (not shown). The process cartridge 300 is described in the order of yellow, magenta, cyan and black in FIG. 8 but the order thereof is not limited thereto.

Typically, a color image forming apparatus has a large size because the color image forming apparatus has multiple image formation portions. In addition, when each unit such as a cleaning device and a charging device is separately broken down and ends its life, the unit is replaced. However, the replacement is inconvenient because the apparatus is complicated. When elements such as an image bearing member, a charging device, a developing device are integrally combined as a process cartridge as described in the embodiment of the present invention mentioned above, a user can easily replace the process cartridge and a small sized color image forming apparatus can be provided.

Next, another embodiment (i.e., a laser printer) of the image forming apparatus will be explained referring to drawings.

Figure 10:
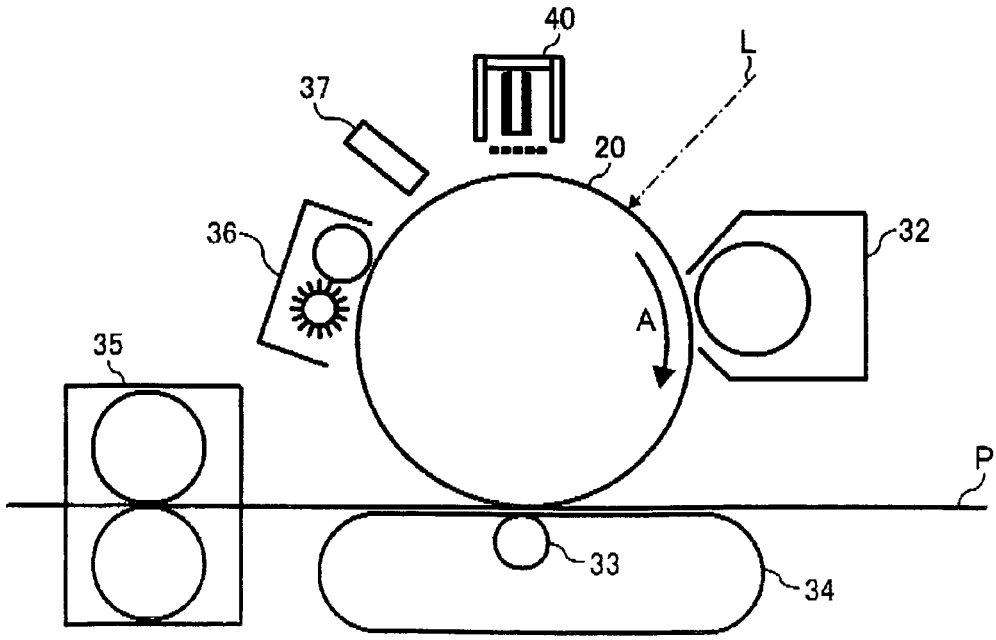
FIG. 10 is a schematic view illustrating a laser printer, which is an embodiment of the image forming apparatus of the present invention.

FIG. 10 is a schematic view illustrating a laser printer (hereinafter referred to as a printer) which is an embodiment of the image forming apparatus of the present invention. The printer is a printer for producing monochrome images, and includes a photoreceptor drum 20 serving as an image bearing member (i.e., a member to be charged). The photoreceptor drum 20 has a diameter of 30 mm, and is rotated by a driving device (not shown) in a direction indicated by an arrow A. The surface (i.e., the surface to be charged) of the photoreceptor drum 20 moves at a speed of 200 mm/sec. The surface of the photoreceptor drum 20 is uniformly charged with a charging device 40. The distance between the surface of the photoreceptor drum 20 and exit openings of the charging device facing the photoreceptor drum is 1 mm. The charging device 40 discharges negative ions from the exit opening to adhere the negative ions to the surface of the photoreceptor drum 20. Thus, the surface of the photoreceptor drum 20 is charged. The detail of the charging device 40 will be explained later in detail.

After the photoreceptor drum 20 is charged, an optical image writing unit (not shown) irradiates the charged surface of the photoreceptor drum 20 with light (L) including image information to form a latent electrostatic image. The thus prepared latent electrostatic image is developed with a developing device 32 (serving as developing means) using a developer including a toner. Thus, a toner image is formed on the photoreceptor drum 20. Since the photoreceptor drum 20 is rotated, the toner image thereon is moved to a transfer region at which the photoreceptor drum 20 faces a transfer roller 33 serving as transfer means. On the other hand, a transfer paper P serving as a recording material, which has been fed from a paper feeding cassette (not shown) and stopped at a pair of registration rollers (not shown), is timely fed by the pair of registration rollers to the transfer region. The transfer paper P is fed through the transfer region by a paper feeding belt 34 (serving as recording material feeding means) while borne on the paper feeding belt 34. A predetermined transfer bias is applied to the transfer roller 34, and thereby a transfer current flows through the transfer region. Due to the thus applied transfer bias, the toner image on the photoreceptor drum 20 is transferred onto the transfer paper P at the transfer region. The transfer paper P bearing the toner image thereon is then fed to a fixing device 35 (serving as fixing means). The toner image is fixed on the transfer paper P by the fixing device 35 upon application of heat and pressure thereto. Then the transfer paper P bearing the fixed toner image thereon is discharged from the printer.

Toner particles remaining on the surface of the photoreceptor drum 20 after the transfer operation are removed therefrom with a cleaning unit 36 (serving as cleaning means). In addition, charges remaining on the surface of the photoreceptor drum 20 after the transfer operation are removed with a discharging lamp 37 (serving as discharging means). Although the printer of this embodiment uses the cleaning unit 36 to remove residual toner particles, the printer can have a cleaner-less configuration such that residual toner particles are collected with the developing device 32, etc.

Next, the charging device 40 of the present invention will be explained.

Figure 9:
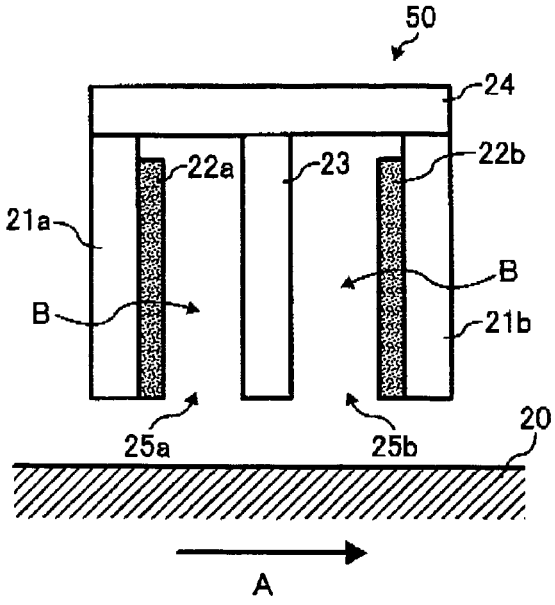
FIG. 9 is a schematic view illustrating a cross section of an example of the charging device of the present invention.

FIG. 9 is a schematic view illustrating a cross section of an example of the charging device of the present invention, which can be preferably used for the printer mentioned above.

Referring to FIG. 9, a charging device 50 includes electrodes 21*a* and 21*b* (hereinafter referred to as electron discharging electrodes) which are located on both ends of the charging device in the direction A (i.e., the rotation direction of the photoreceptor drum 20) and which are made of a material such as aluminum. Electron discharging layers 22*a* and 22*b* are provided on the inner walls of the electron discharging electrodes 21*a* and 21*b*, respectively. Each of the electron discharging layers 22*a* and 22*b* is made of a film of an electron discharging element or a layer in which a powder of an electron discharging element is fixedly dispersed.

In addition, the charging device 50 further includes an opposing electrode 23 which is located in the center of the charging device 50 and which is made of a material such as aluminum. These electrodes 21*a*, 21*b* and 23 are fixed on an insulating support 24 which is made of a material such as resins such that the distance between the electrode 21*a* or 21*b* and the opposing electrode 23 be a predetermined distance. A space B (hereinafter sometimes referred to as an ion generation space) formed between the electrode 21*a* or 21*b* and the opposing electrode 23 opens toward the photoreceptor drum 20 while the opposite side of the space B is shut by the insulating support 24. Thus, exit openings 25*a* and 25*b* are formed at the lower end of the charging device 50.

In this embodiment, a voltage is applied to the electrode discharging electrodes 21*a* and 21*b* from a DC power supply (not shown) serving as voltage application means. Therefore, an electric field is formed between the electrode 21*a* or 21*b* and the opposing electrode 23 which is grounded. Thereby electrons are discharged from the electron discharging layers 22*a* and 22*b*. The thus discharged electrons are adhered to molecules of gaseous materials such as oxygen, carbon dioxide, and nitrogen gasses or combinations of such gaseous materials and water, thereby negatively ionizing the molecules, resulting in formation of negative ions. The thus formed negative ions escape from the exit openings 25*a* and 25*b*, and adhere to the surface of the photoreceptor drum 20. Therefore, the surface of the photoreceptor drum 20 are negatively charged.

The charging device 50 of the present invention has an advantage such that the amount of ozone and NOx generated in the charging operation is much lower than that in the case using a conventional charging device. The reason therefore is as follows.

In general, charging utilizing corona discharging generates a large amount of ozone and NOx. This is because electrons generated by corona discharging collide against molecules of gaseous materials, resulting in formation of ions. Specifically, electrons discharged from a corona wire have an energy of not less than 30 eV. Since the energy for ionizing a nitrogen molecule and an oxygen molecule is 24.3 eV, and 8 eV, respectively, electrons discharged from a corona wire can easily ionize molecules of nitrogen and oxygen.

In contrast, in the charging device 50 of the present embodiment, a relatively low voltage is applied to the electrodes 21*a* and 21*b* so as not to cause discharging in the space B, i.e., the voltage is lower than the threshold voltage in the Paschen's law over which discharging is caused. In addition, since the electron discharging element includes a 5H-BN material having $sp^3$ bond, electrons discharged from the element have an energy of about 6 eV. Therefore, ionization of nitrogen and oxygen is not caused. Namely, in the present charging device, ions can be formed without generating discharge-induced products such as ozone and NOx.

The 5H-BN materials having $sp^3$ bond have the same bond-structure as that of diamond, and are one kind of boron nitride compounds which have the hardness next to diamond. Boron nitride compounds have a good combination of heat resistance and chemical resistance so as to be used for crucibles. Therefore, the materials have excellent durability so as to be used as heavy duty electron discharging elements.

The 5H-BN materials having $sp^3$ bond can be prepared by irradiating a substrate made of a material such as silicon and nickel with a mixture gas plasma (diborane (i.e., hydrogenated boron ($B_2H_6$)), hydrogen, ammonia, and argon) and a defocused ultraviolet excimer laser having a wavelength of 193 nm and a frequency of 1030 Hz. As a result, a thin layer is formed on the substrate. The thin layer has a number of projections with a length of about 10 μm, which have a spindle form having a sharp tip and which are arranged so as to be parallel to the laser irradiation direction. The projections serve as electron emitters.

The electron discharging layers 22*a* and 22*b* are formed on the electron discharging electrodes 21*a* and 21*b*, respectively, by forming a thin layer of a 5H-BN material having $sp^3$ bond or a layer in which a powder of a 5H-BN material is fixed using a binder such as electroconductive resins. Specific examples of the film forming methods include printing methods and sputtering methods. It is preferable for the electron discharging layers 22*a* and 22*b* that a number of particles of a 5H-BN material are present on the surface of the layers.

In this embodiment, a thin layer of a 5H-BN material or a layer in which a 5H-BN material is dispersed in a binder is adhered to the electrodes 21*a* and 21*b* using an electroconductive adhesive. Then the electrodes 21*a* and 21*b* bearing the respective electron discharging layers 22*a* and 22*b* are arranged so as to face the opposing electrode 23 with a gap therebetween. When a voltage is applied to the electrodes 21*a* and 21*b*, electrons are discharged by the electron discharging layers 22*a* and 22*b*, resulting in formation of negative ions in the spaces B.

In this embodiment, 5H-BN materials having $sp^3$ bond are used as the electron discharging material in view of safety and life. However, the electron discharging material is not limited thereto, and other electron discharging materials such as carbon nano tube, and diamond like carbon can also be used therefor.

In order to discharge electrons sufficient for charging the photoreceptor drum 20 so as to have a predetermined potential, the electron discharging layers 22*a* and 22*b* preferably has a large surface area. If the electron discharging layers 22*a* and 22*b* are set so as to face the photoreceptor drum 20 (similarly to the conventional charging devices), the charging device has to have a large width in the direction (not less than twice the vertical length of the layer 22*a* (or 22*b*) in FIG. 9).

In contrast, in the present example, the electron discharging layers 22*a* and 22*b* are set so as to be parallel to the normal direction of the photoreceptor drum 20 as illustrated in FIG. 9. In this regard, the width of the charging device 50 depends on the gap between the electron discharging electrodes 21*a* and 21*b* and the opposing electrode 23. In other words, the width of the charging device 50 does not depend on the vertical length of the electron discharging layers 22*a* and 22*b*. Since the gap between the electron discharging electrodes 21*a* and 21*b* and the opposing electrode 23 is on the order of 300 μm, the length of the charging device 50 in the direction A can be dramatically decreased, resulting in miniaturization of the image forming unit of the image forming apparatus. Specifically, the length of the charging device 50 in the direction A is about 1.5 mm in this example.

Figure 11:
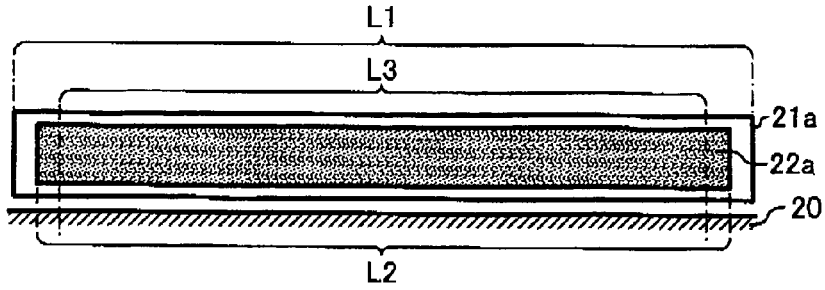
FIGS. 11-14 are elevation views of electron discharging layers for use in the charging device of the present invention.
Figure 12:
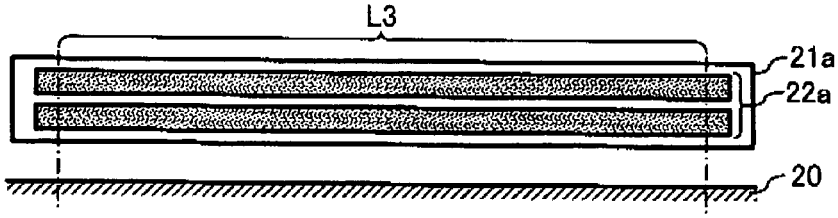
Figure 13:
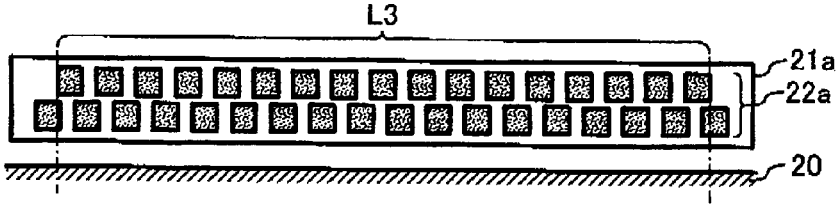

Next, the structure of the electron discharging layers 22 (22*a* and 22*b*) will be explained in detail referring to FIGS. 11-14. In FIGS. 11-13, only the electron discharging layer 22*a* is illustrated because the other electron discharging layer 22*b* has the same structure.

FIG. 11 is an elevation view of the electron discharging layer 22*a* formed on the electron discharging electrode 21*a*.

As illustrated in FIG. 11, the electron discharging electrode 21*a* has a rectangular form in which a length L1 of the side of the rectangle parallel to the axial direction of the photoreceptor drum 20 is longer than the other side (i.e., the height thereof). The length L1 is longer than a length L3 of the image forming area within which an image is formed on the photoreceptor drum 20. As illustrated in FIG. 11, the electron discharging electrode 21*a* and the electron discharging layer 22*a* are set such that the longitudinal direction thereof is parallel to the axial direction of the photoreceptor drum 20 and surfaces of the electrode and the layer are parallel to the normal direction of the photoreceptor drum 20. Character L2 denotes a length of the electron discharging layer 22*a*.

In this embodiment, a voltage of −1200V is applied to the electron discharging electrode 21*a*. As a result, the surface of the photoreceptor drum 20, whose surface is rotated at a linear speed of 200 mm/s, is evenly charged to have a potential of −400V.

FIG. 12 is an elevation view of another example of the electron discharging layer 22*a* formed on the electron discharging electrode 21*a*. The electron discharging layer 22*a* has two rectangular electron discharging portions in which the side thereof parallel to the axial direction of the photoreceptor drum 20 is longer than the other side thereof. Similarly to the electron discharging layer illustrated in FIG. 11, the length of the side of the electron discharging portion parallel to the axial direction of the photoreceptor drum 20 is longer than the length (L3) of the image forming area of the photoreceptor drum 20. In addition, the electron discharging electrode 21*a* and the electron discharging layer 22*a* are set similarly to the electron discharging electrode 11*a* illustrated in FIG. 11. As a result of the present inventors' experiment, it is found that the electron discharging layer of this example has the same chargeability as that of the electron discharging layer illustrated in FIG. 11.

Next, another example of the electron discharging layer 12 will be explained.

FIG. 13 is an elevation view of another example of the electron discharging layer 22*a* formed on the electron discharging electrode 21*a*.

The electron discharging layer 22*a* includes two lines of electron discharging portions each of which includes a plurality of small rectangular electron discharging portions arranged in the longitudinal direction of the electrodes 21*a* (i.e., in the axial direction of the photoreceptor drum 20). Similarly to the above-mentioned two examples of the electron discharging layer, the length of one line of the electron discharging portion in the longitudinal direction is longer than the length (L3) of the image forming area of the photoreceptor drum 20. In addition, the electron discharging electrode and the electron discharging layer are set similarly to the electron discharging electrode 21*a* illustrated in FIG. 11. As illustrated in FIG. 13, the electron discharging portions in one line are arranged to face the gaps between the electron discharging portions in another line. By taking such a configuration, the electron discharging portions can evenly discharge electrons in the longitudinal direction thereof. As a result of the present inventors' experiment, it is found that the electron discharging layer of this example has the same chargeability as that of the electron discharging layers illustrated in FIGS. 11 and 12.

In the above-mentioned three examples of the electron discharging layer, both the electron discharging layers 22*a* and 22*b* have the same structure. However, the electron discharging layers 22*a* and 22*b* can have different structures. For example, it is possible to use the electron discharging layers illustrated in FIGS. 11 and 12 for the electron discharging layers 22*a* and 22*b*, respectively.

Next, another example of the electron discharging layer 22 will be explained.

Figure 14:
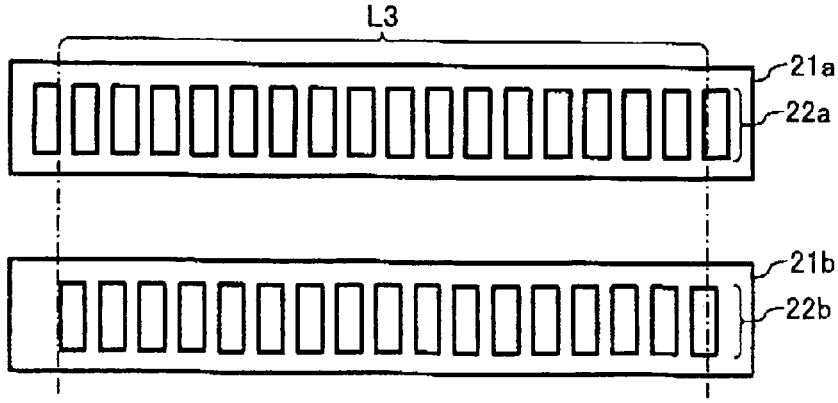

FIG. 14 is an elevation view of another example of the electron discharging layers 22*a* and 22*b* formed on the electron discharging electrode 21*a* and 21*b*, respectively.

The electron discharging layer 22*a* includes a line of electron discharging portions including a plurality of small rectangular electron discharging portions arranged in the longitudinal direction of the electrodes 21*a* (i.e., in the axial direction of the photoreceptor drum 20). Similarly, the electron discharging layer 22*b* includes a line of electron discharging portions including a plurality of small rectangular electron discharging portions arranged in the longitudinal direction of the electrodes 21*b* (i.e., in the axial direction of the photoreceptor drum 20). Similarly to the above-mentioned three examples of the electron discharging layer, the length of the line of electron discharging portions in the longitudinal direction is longer than the length of the image forming area of the photoreceptor drum 20. In addition, the electron discharging electrode 21*a* and the line of electron discharging portions are set similarly to the electron discharging electrode 21*a* illustrated in FIG. 11.

As illustrated in FIG. 14, the electron discharging portions of the electron discharging layer 22*b* formed on the electron discharging electrode 21*b* are set so as to face the gaps formed between the electron discharging portions of the electron discharging layer 22*a* formed on the electron discharging electrode 21*a*. By taking such a configuration, the electron discharging layers 22*a* and 22*b* can evenly discharge electrons in the longitudinal direction thereof. As a result of the present inventor's experiment, it is found that the electron discharging layer of this example has the same chargeability as that of the electron discharging layers illustrated in FIGS. 11 to 13.

Next, another example of the charging device of the present invention will be explained.

Figure 15:
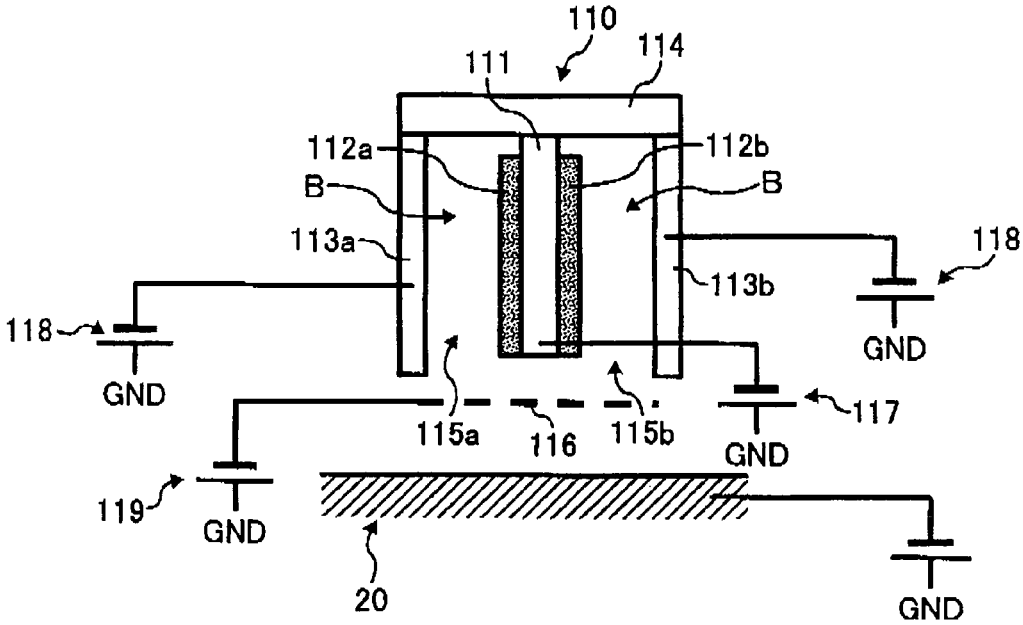
FIGS. 15-24 are schematic views illustrating other examples of the charging device of the present invention.

FIG. 15 illustrates the cross section of another example of the charging device. As can be understood from FIG. 15, a charging device 110 has the same configuration as that of the charging device illustrated in FIG. 9 except that electron discharging layers 112*a* and 112*b* are formed on both sides of a center electrode 111 serving as an electron discharging electrode. Electrodes 113*a* and 113*b* serves as opposing electrodes. In addition, the charging device 110 includes a grid electrode 116 configured to transport negative ions formed in the spaces B toward exit openings 115*a* and 115*b*, i.e., toward the surface of the photoreceptor drum 20.

The electron discharging layers 112*a* and 112*b* formed on the electron discharging electrode 111 have a structure similar to those illustrated in FIGS. 10 to 14.

When a first DC power source 117 applies a voltage to the electron discharging electrode 111 and a second DC power source 118 applies a voltage to the opposing electrodes 113*a* and 113*b*, an electric field is formed between the electron discharging electrode 111 and the opposing electrodes 113*a* and 113*b*, and thereby negative ions are formed in the spaces B.

In this example, the grid electrode 116 is made of stainless steel, and a voltage is applied to the grid electrode 116 by a grid power source 119. Similarly to the grid electrodes used for conventional scorotron charging devices, the grid electrode 116 has a honey comb form. However, the grid electrode 116 is not limited thereto, and any grid electrodes which can pass ions can be used therefor. For example, electroconductive films and electroconductive plate having openings can also be used. The distance between the tip of the electron discharging electrode 111 and the grid electrode 116 and the distance between the tips of the opposing electrodes 113*a* and 113*b* and the grid electrode 116 are set at a distance such that discharging is not caused. Specifically, in this embodiment, the distance is set to be 500 μm. In addition, the distance between the grid electrode 116 and the surface of the photoreceptor drum 20 is set to be 1 mm.

The negative ions generated in the space B are transported toward the surface of the photoreceptor drum 20 by the grid electrode 116 to which a voltage is applied. In order to generate negative ions and transport the ions toward the photoreceptor drum, it is preferable to satisfy the following relationship (1):

$$|A|>|B|>C \tag{1}$$

wherein A represents the voltage (V) applied to the electron discharging electrode 111; B represents the voltage (V) applied to the opposing electrodes 113*a* and 113*b*; and C represents the voltage (V) applied to the grid electrode 116.

When the relationship (1) is satisfied, the electrons discharged from the electron discharging layers 112*a* and 112*b* move toward the opposing electrodes 113*a* and 113*b*. When the electrons collide against molecules of gaseous materials in the space B, negative ions are formed. The thus formed negative ions move toward the grid electrode 116. Since the potential of the surface of the photoreceptor drum 20 has been decreased to about 0V by the discharging lamp 37, the negative ions pass the grid electrode 116 and adhere to the surface of the photoreceptor drum 20. After the potential of the surface of the photoreceptor drum 20 is increased to substantially the same voltage as that of the grid electrode 116 due to adhesion of negative ions, negative ions present in the vicinity of the grid electrode 116 do not move toward the photoreceptor drum 20. Thus, transportation of negative ions can be accelerated by the migration electric field formed by the voltage applied to the grid electrode 116. Numeral 114 denotes an insulating support.

In this example, a voltage of −1200V is applied to the electron discharging electrode 111 by the first DC power source 117; a voltage of −800V is applied to the opposing electrodes 113*a* and 113*b* by the second DC power source 118; and a voltage of −650V is applied to the grid electrode 116 by the grid power source 119. As a result, the surface of the photoreceptor drum 20 is evenly charged to a potential of −600V, which is much higher than the potential (−400V) of the photoreceptor drum 20 in the examples mentioned above.

Thus, it is confirmed that the grid electrode 116 can enhance the charging ability of the charging device. In FIG. 15, character GND means a ground.

Figure 16:
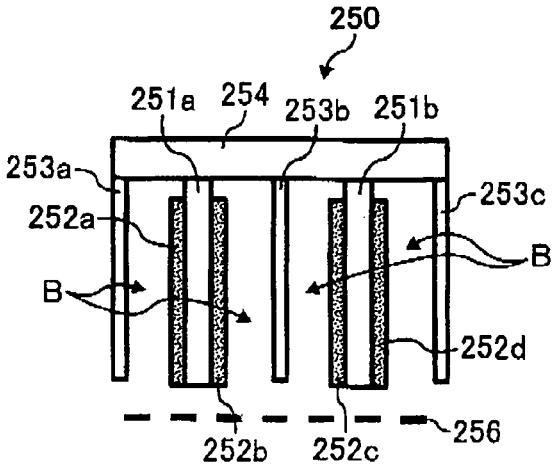

FIG. 16 is a cross section of another example of the charging device of the present invention.

As can be understood from FIG. 16, a charging device 250 has the same configuration as that of the charging device 110 mentioned above except that four ion generation spaces B are formed. Specifically, the charging device 250 has three opposing electrodes 253*a*, 253*b* and 253*c*, and two electron discharging electrodes 251*a* and 251*b*, each of which is located between two opposing electrodes. On both sides of the electron discharging electrodes 251*a* and 251*b*, electron discharging layers 252*a*, 252*b*, 252*c* and 252*d* are formed. The voltages applied to the electrodes are the same as those in the charging device 110 in FIG. 15.

In this charging device 250, the total surface area of the electron discharging layer is twice that in the charging device 110. Therefore, the amount of electrons generated by the electron discharging layers can be dramatically increased, and thereby the amount of generated negative ions can be dramatically increased. Therefore, this charging device can be preferably used for high speed image forming apparatus. Numerals 254 and 256 denote an insulating support, and a grid electrode.

Figure 17:
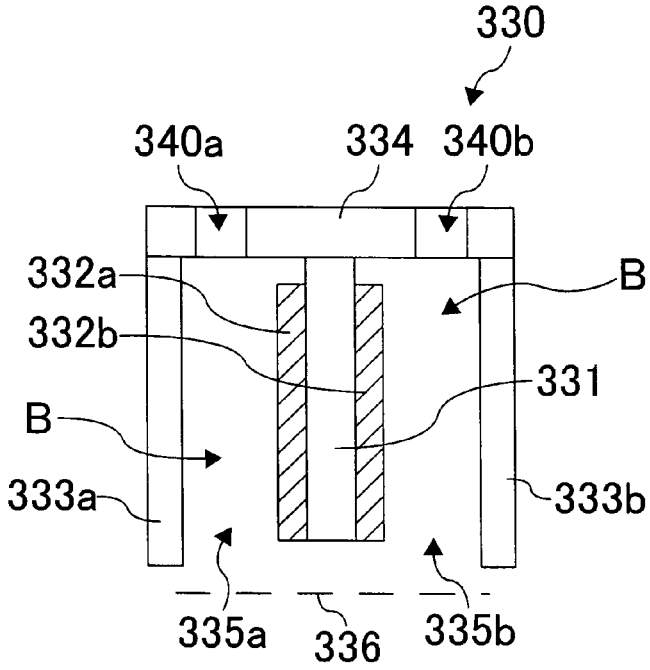

FIG. 17 is a cross section of another example of the charging device of the present invention.

As can be understood from FIG. 17, a charging device 330 has the same configuration as that of the charging device 110 mentioned above except that an insulating support 334 has openings 340*a* and 340*b* configured to supply outside air to the spaces B. The charging device 330 includes an electron discharging electrode 331, opposing electrodes 333*a* and 333*b* and the insulating support 334, which surround the ion generation spaces B. In addition, the charging device 330 has exit openings 335*a* and 335*b* through which generated ions move toward the surface of the photoreceptor drum; and the openings 340*a* and 340*b* through which outside air is supplied to the spaces B.

Since the charging device 330 has the openings 340*a* and 340*b* on the upper portion of the spaces B, air can be smoothly flown, and thereby negative ions can be efficiently discharged from the exit openings 335*a* and 335*b*. In this regard, air is flown from the openings 340*a* and 340*b* to the openings 335*a* and 335*b*. Therefore, the negative ions are further efficiently discharged from the openings 335*a* and 335*b*. Thus, negative ions can be efficiently transported to the surface of the photoreceptor drum, resulting in enhancement of the charging ability of the charging device.

It is preferable to arrange air supplying openings (i.e., the openings 340*a* and 340*b*) so as to face the openings 335*a* and 335*b*, respectively, because air can be linearly flown through the spaces B, thereby efficiently discharging negative ions from the exit openings 335*a* and 335*b*. Numeral 336 denotes a grid electrode.

Air supplying openings can be preferably used for not only a charging device having a grid electrode but also a charging device including no grid electrode.

In this example, air supplying openings are formed so as to face the exit openings 335*a* and 335*b*. However, air supplying openings can be provided at such a location as not to face the exit openings 335*a* and 335*b*. For example, in a charging device 350 illustrated in FIG. 18, opposing electrodes 353*a* and 353*b* have respective air supplying openings 360*a* and 360*b* on an upper portion thereof. In this case, the openings 360*a* and 360*b* are preferably formed at locations so as to be apart from the openings 335*a* and 335*b* as far as possible. In addition, it is preferable that the openings 360*a* and 360*b* do not face the electron discharging layers 332*a* and 332*b*. In this case, an electron discharging electrode 351 may have an opening (i.e., a passage) 361 to connect the two spaces B with each other.

In this example, each of the air supplying openings 360*a* and 360*b* is one opening which fully extends in the longitudinal direction of the charging device (i.e., in the axial direction of the photoreceptor drum 20). However, the openings are not limited thereto, and one partial opening or combinations of plural openings can also be used therefore.

In addition, the charging device can include a fan (i.e., air flow generating means) configured to forcibly supply air from the openings 360*a* and 360*b* to the spaces B. In this case, the air in the spaces B can be flown at a high speed toward the exit openings 335*a* and 335*b*, thereby efficiently discharging negative ions from the exit openings 335*a* and 335*b*. A fan, which is provided in the printer for another purpose, can be used for the air flow generating means instead of the fan provided in the charging device. Numerals 351 and 354 denote an electron discharging electrode and an insulating support, respectively.

Figure 19:
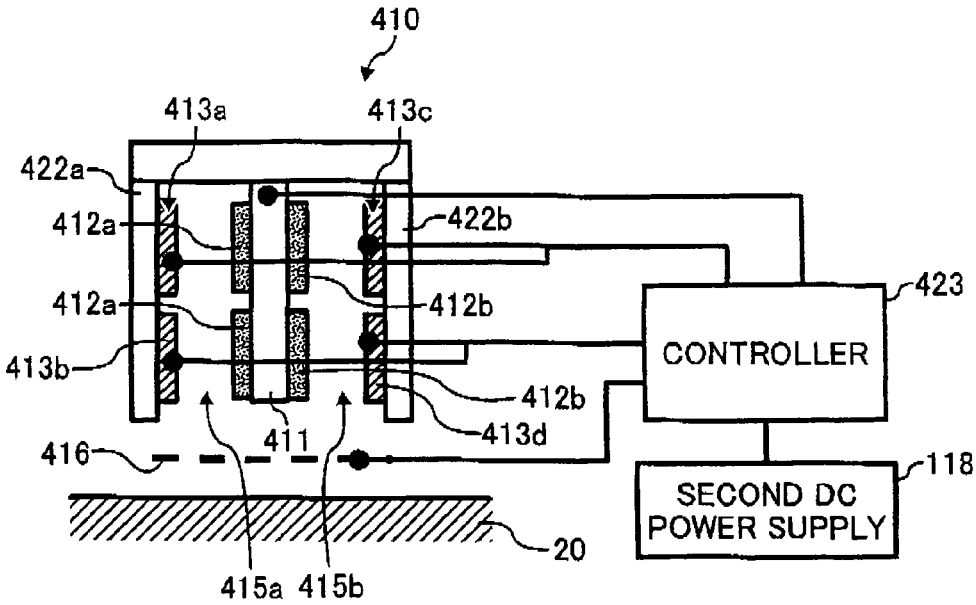

FIG. 19 is a cross section of another example of the charging device of the present invention.

In a charging device 410 illustrated in FIG. 19, electron discharging layers 412*a* and 412*b* formed on an electron discharging electrode 411 have the configuration as illustrated in FIG. 12. In addition, opposing electrodes 413*a* and 413*b* are formed on an insulating support 422*a* so as to face the electron discharging layer 412*a*, and opposing electrodes 413*c* and 413*d* are formed on an insulating support 422*b* so as to face the electron discharging layer 412*b*. The opposing electrodes 413*a* and 413*c* are farther apart from openings 415*a* and 415*b* than the opposing electrodes 413*b* and 413*d*.

In each of the ion generating spaces, two electric fields are formed by an upper electric field forming section (i.e., a combination of upper one of the electron discharging layer 412*a* (or 412*b*) and the opposing electrode 413*a* (or 413*c*)) and a lower electric field forming section (i.e., a combination of lower one of the electron discharging layer 412*a* (or 412*b*) and the opposing electrode 413*b* (413*d*)).

In the charging device 410, a voltage is applied from the second DC power source 118 to the opposing electrodes 413*a*-413*d* while controlled by a controller 423. Specifically, the controller 423 controls the voltage applied to the opposing electrodes such that at first an electric field is formed in the lower electric field forming section and then an electric field is formed in the upper electric field forming section.

Specifically, at first the controller 423 applies a voltage of −800V to the opposing electrodes 413*b* and 413*d* to form an electric field in each of the lower electric field forming sections while applying a voltage of −1200V to the opposing electrodes 413*a* and 413*c* not to form an electric field in each of the upper electric field forming sections. In this regard, a voltage of −1200V is applied to the electron discharging electrode 411. Thus, negative ions are formed in the lower portions of the spaces B near exit openings 415*a* and 415*b* while ions are not formed in the upper portions of the ion generation spaces. The thus generated negative ions in the lower portions of the ion generation spaces are efficiently moved toward the surface of the photoreceptor drum 20 due to the migration electric field of a grid electrode 416 and the voltage applied to the upper opposing electrodes 413*a* and 413*c*.

The controller 423 then applies a voltage of −800V to the opposing electrodes 413*a* and 413*c* to form an electric field in each of the upper electric field forming sections while applying a voltage of −1200V to the opposing electrodes 413*b* and 413*d* not to form an electric field in each of the lower electric field forming sections. Thus, negative ions are formed in the upper portions of the ion generation spaces while ions are not formed in the lower portions of the ion generation spaces. Since a voltage of −1200V is applied to the opposing electrodes 413*b* and 413*d*, the negative ions formed in the upper electric field forming sections cannot move toward the lower electric field forming sections and remain in the upper electric field forming sections.

The controller 423 then applies a voltage of −800V to the opposing electrodes 413*b* and 413*d* to form an electric field in each of the lower electric field forming sections while applying a voltage of −1200V to the opposing electrodes 413*a* and 413*c* not to form an electric field in each of the upper electric field forming sections. In this case, negative ions are formed in the lower electric field forming sections, and in addition the negative ions remaining in the upper electric field forming sections move toward the lower electric field forming sections. Thus, these negative ions move toward the surface of the photoreceptor drum 20.

By repeating these voltage application operations, negative ions generated in the upper electric field forming sections are sequentially transported to the surface of the photoreceptor drum 20. Namely, by using this charging device, movement of negative ions generated in the upper portions of the ion generation spaces can be accelerated. When such a voltage control operation is not performed, the negative ions generated in the upper portions of the ion generation spaces tend to be attracted by the opposing electrodes even if a grid electrode is provided. Therefore, it is preferable to perform such a voltage control operation in order to efficiently move the negative ions in the ion generation spaces toward the surface of the photoreceptor drum 20.

In particular, by timely changing the voltage applied to the lower opposing electrodes and the upper opposing electrodes, negative ions can be efficiently transported toward the surface of the photoreceptor drum 20 at a high speed. Therefore, this charging device has a higher charging ability.

Figure 20:
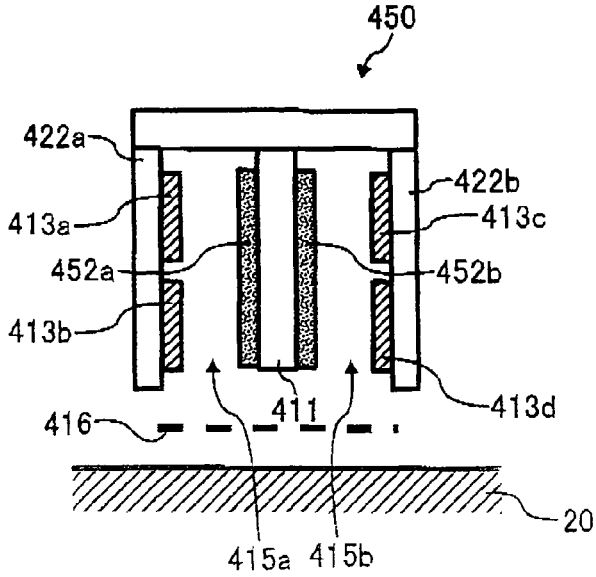

In this example, the electron discharging layers 412*a* and 412*b* have the configuration as illustrated in FIG. 12. However, the configuration of the electron discharging layers 412*a* and 412*b* is not limited thereto, and other configurations such as those illustrated in FIGS. 11, 13 and 14 can also be available. One example is a charging device 450 illustrated in FIG. 20, in which electron discharging layers 452*a* and 452*b* have the configuration as illustrated in FIG. 11.

Figure 21:
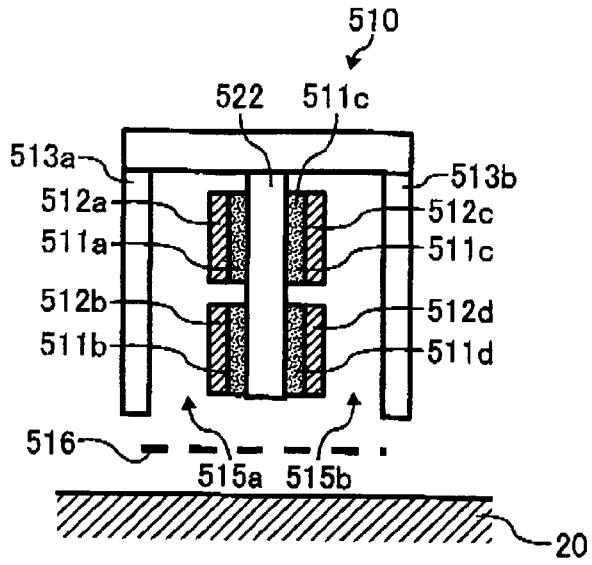

FIG. 21 is a cross section of another example of the charging device of the present invention.

In a charging device 510 illustrated in FIG. 21, the voltages applied to electron discharging electrodes 511*a*, 511*b*, 511*c* and 511*d* are controlled. Specifically, the charging device 510 includes opposing electrodes 513*a* and 513*b* which are located on both sides of the charging device; and an insulating electrode support 522 which is located in the center of the charging device. On one side of the insulating electrode support 522, the electron discharging electrodes 511*a* and 511*b* are formed side by side in the vertical direction. Similarly, on the other side of the insulating electrode support 522, the electron discharging electrodes 511*c* and 511*d* are formed side by side in the vertical direction. In addition, electron discharging layers 512*a*, 512*b*, 512*c* and 512*d* are formed on the electron discharging electrodes 511*a*, 511*b*, 511*c* and 511*d*, respectively.

As can be understood from FIG. 21, the electron discharging layers 511*a* and 511*c* are farther apart from exit opening 515*a* and 515*b* than the electron discharging layers 511*b* and 511*d*. Thus, the charging device 510 has upper electric field forming sections in which an electric field is formed by a combination of the electron discharging layer 511*a* and the opposing electrode 513*a* and a combination of the electron discharging layer 511*c* and the opposing electrode 513*b*, and lower electric field forming sections in which an electric field is formed by a combination of the electron discharging layer 511*b* and the opposing electrode 513*a* and a combination of the electron discharging layer 511*d* and the opposing electrode 513*b*.

By performing a voltage controlling similar to that mentioned above in the charging device illustrated in FIG. 19, negative ions generated in the upper portions of the ion generation spaces can be efficiently transported toward the surface of the photoreceptor drum 20. Numeral 516 denotes a grid electrode.

Figure 22:
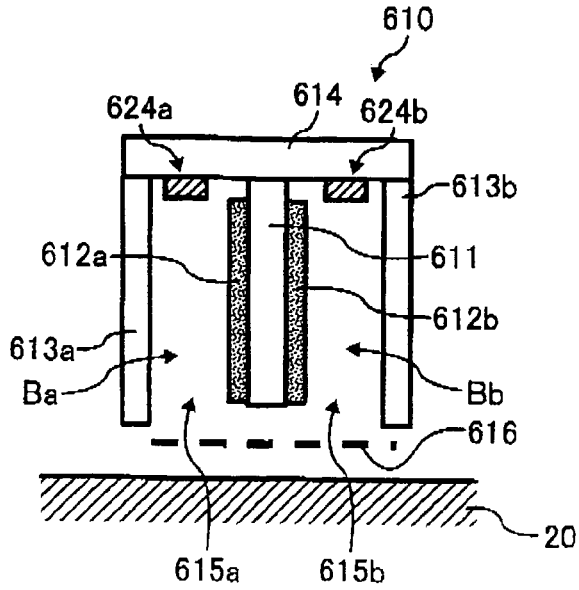

FIG. 22 is a cross section of another example of the charging device of the present invention.

In a charging device 610 illustrated in FIG. 22, second opposing electrodes 624*a* and 624*b* are formed on an insulating support 614. A voltage (e.g., −800V) higher than the voltage (−650V) applied to a grid electrode 616 is applied to the second opposing electrodes 624*a* and 624*b*. By applying such a voltage to the second opposing electrodes 624*a* and 624*b*, an electric field is formed in spaces Ba and Bb, and thereby negative ions in the spaces Ba and Bb can be efficiently transported toward openings 615*a* and 615*b*.

It is possible for the charging device 610 to control the voltage applied to an electron discharging electrode 611 and at least one of the voltages applied to opposing electrodes 613*a* and 613*b* to alternately form an electric field in the space Ba and the space Bb. In this case, a voltage is preferably applied to the second opposing electrodes 624*a* (or 624*b*) when an electric field is not formed in the space Ba (or Bb). By thus controlling application of voltage, an electric field for moving negative ions in the space Ba (or Bb), in which no other electric field is formed, toward the grid electrode 616 is formed. Therefore, the negative ions in the space Ba (or Bb) can be efficiently transported to the surface of the photoreceptor drum 20. Numerals 612*a* and 612*b* denote electron discharging layers.

Figure 23:
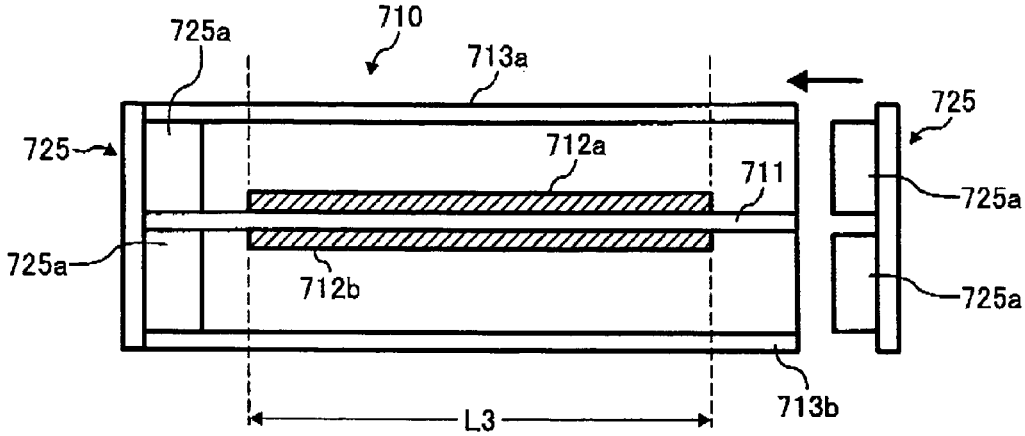

FIG. 23 is a plan view of another example of the charging device of the present invention.

A charging device 710 illustrated in FIG. 23 includes a spacer 725 on both sides of the charging device to keep the distance between an electron discharging electrode 711 and an opposing electrode 713*a* or 713*b* constant. Specifically, the spacer includes an insert portion 725*a*, and the insert portion 725*a* is inserted into gaps between the electron discharging electrode 711 and the opposing electrodes 713*a* and 713*b*. By providing such a spacer, the distance between an electron discharging electrode 711 and the opposing electrode 713*a* or 713*b* can be precisely controlled, and thereby a uniform electric field can be stably formed in the ion generation spaces therebetween. Therefore, a constant amount of negative ions can be formed in the spaces, and thereby the photoreceptor drum can be uniformly charged. In FIG. 23, numerals 712*a* and 712*b* denote an electron discharging layer.

Figure 24:
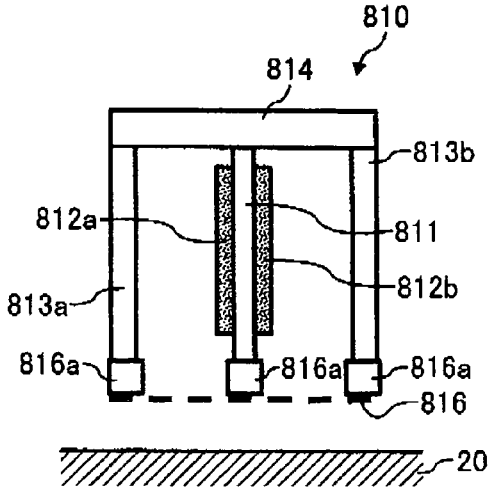

FIG. 24 is a cross section of another example of the charging device of the present invention.

In a charging device 810 illustrated in FIG. 24, a grid electrode 816 also serves as an electrode supporting mechanism configured to keep the distance between an electron discharging electrode 811 and an opposing electrode 813*a* or 813*b* constant. Specifically, the electrode supporting mechanism includes the grid electrode 816 and a fixing member 816*a* which is made of an insulating material and which fixes the electron discharging electrode 811 and opposing electrodes 813*a* and 813*b* to the grid electrode 816 such that the distances between the electron discharging electrode 811 and opposing electrodes 813*a* and 813*b* can be stably kept constant. Therefore, a uniform electric field can be stably formed in the ion generation spaces therebetween. Accordingly, a constant amount of negative ions can be formed in the ion generation spaces, and thereby the photoreceptor drum can be uniformly charged. In FIG. 24, numerals 812*a* and 812*b* denote an electron discharging layer, and numeral 814 denotes an insulating support.

The above-mentioned charging devices serve as charge applying devices for charging the photoreceptor drum 20. Negative ions generated in the ion generation spaces in the discharging devices are adhered to the surface of the photoreceptor drum 20. Thus, the image forming portion of the photoreceptor drum 20 is charged. In conventional charging devices used for charging a photoreceptor, the photoreceptor serves as an opposing electrode. In contrast, an opposing electrode, which is not a photoreceptor, is provided as a part in the charging device of the present invention. Therefore, the distance between the electrodes can be stably kept constant. Therefore, a predetermined electric field can be stably formed in the charging device, and thereby the amount of electrons discharged from the electron discharging layers can be controlled to be constant. Accordingly, the photoreceptor drum 20 can be stably charged so as to have a predetermined potential.

In addition, since the photoreceptor drum 20 does not serve as an opposing electrode in the charging device of the present invention, problems such as deterioration (oxidation and destruction) of the materials used for the photoreceptor drum (such as binder resins (e.g., polycarbonate resins) and photosensitive materials) are not caused, and thereby abrasion of the photosensitive layer can be avoided and the life of the photoreceptor drum can be prolonged. Further, discharge-induced materials such as ozone and NOx are hardly produced. Furthermore, in the charging device of the present invention a relatively low voltage is applied to the charging members compared to that applied to charging members in conventional charging devices. Therefore, energy can be saved.

In the charging devices mentioned above, the electron discharging electrodes and the opposing electrodes are plates and are provided so as to parallel to each other, and the electron discharging member is an electron discharging layer which is formed on the electron discharging electrodes and which has substantially a uniform thickness. Therefore, the amount of electrons discharged from the electron discharging member can be controlled so as to be constant, and thereby the surface of the photoreceptor drum 20 can be uniformly charged so as to have a predetermined potential.

In the charging devices illustrated in FIGS. 11 and 12, the electron discharging layers extend in the axial direction of the photoreceptor drum 20. Therefore, the surface area of the electron discharging layers can be maximized in a limited space. Therefore, the charging devices can produce a large amount of electrons.

In the charging devices illustrated in FIGS. 13 and 14, a plurality of electron discharging portions serving as an electron discharging layer are arranged in the longitudinal direction of the charging devices. When a long electron discharging layer (such as the layers illustrated in FIGS. 11 and 12) is prepared, there is a case where the resultant electron discharging layer has unevenness particularly in the longitudinal direction thereof, resulting in uneven charging of the photoreceptor drum in the axial direction of the photoreceptor drum. By using an electron discharging layer including a plurality of electron discharging portions, such uneven charging can be avoided even when discharging ability of the electron discharging portions slightly varies. The reason therefor is that since such varied electron discharging members are randomly arranged, the variation tends to be cancelled and the resultant electron discharging layers tend to have an average electron discharging ability in the longitudinal direction thereof. Therefore, the amount of electrons discharged from the electron discharging member can be controlled so as to be constant, and thereby the surface of the photoreceptor drum 20 can be uniformly charged.

In particular, in the electron discharging layers illustrated in FIGS. 13 and 14, plural electron discharging portions are arranged in the longitudinal direction thereof without forming an electron non-discharging portion. Specifically, even though the electron discharging portions are arranged with a gap therebetween, the gap is arranged so as to face another electron discharging portion. Therefore, the photoreceptor drum 20 can be uniformly charged in the axial direction thereof.

In the charging device illustrated in FIG. 19, a plurality of electron discharging layers are arranged in the vertical direction to form upper and lower electric field forming sections. By forming an electric field in the lower electric field forming section, followed by formation of an electric field in the upper electric filed forming section, the negative ions generated in the ion generation spaces can be efficiently transported to the exit openings 415*a* and 415*b*. Therefore, the image forming surface of the photoreceptor drum 20 can be uniformly charged.

In the charging devices illustrated in FIGS. 15-24, a grid electrode is provided in the vicinity of the exit openings of the spaces B to move the negative ions toward the image forming surface of the photoreceptor drum 20. In the charging devices, the following relationship (1) is satisfied:

$$|A|>|B|>|C| \quad (1)$$

wherein A represents the voltage (V) applied to the electron discharging electrode; B represents the voltage (V) applied to the opposing electrode; and C represents the voltage (V) applied to the grid electrode.

In this case, the negative ions generated in the spaces can be efficiently transported toward the photoreceptor drum and thereby the image forming surface of the photoreceptor drum can be efficiently charged.

Figure 18:
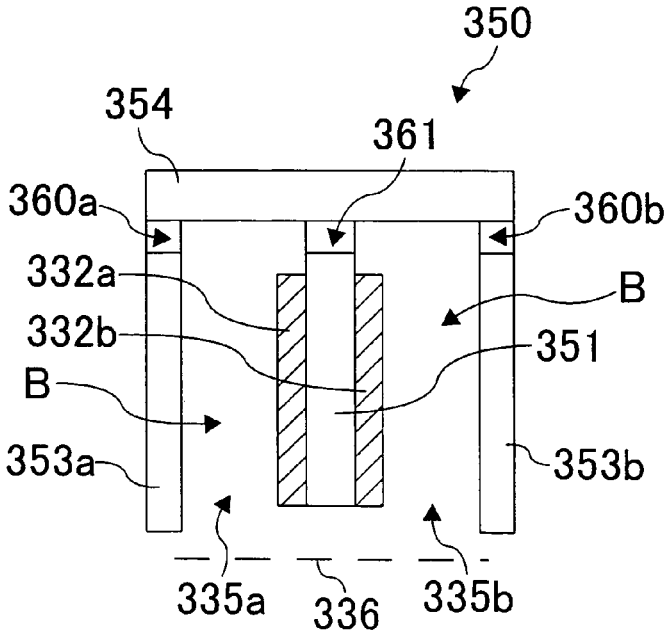

The charging devices illustrated in FIGS. 17 and 18 include air supplying openings which can form air flow to supply air to the spaces B. As a result, the negative ions generated in the spaces B can be efficiently transported to the photoreceptor drum. Therefore, the charging devices have an improved charging ability. In addition, since flesh air is supplied to the spaces B, ionization of gaseous materials in the spaces B can be stably performed, and thereby charging can be stably performed.

The charging devices illustrated in FIGS. 9 and 15-24 have an electrode supporting mechanism (e.g., the insulating supports and the spacer). Therefore, the distance between the electron discharging electrode and the opposing electrode can be kept constant, and thereby an electric field can be stably formed in the spaces B. Accordingly, the amount of electrons discharged from the electron discharging layers can be controlled so as to be substantially constant, and thereby a constant amount of negative ions can be generated in the spaces B. Therefore, the image forming surface of the photoreceptor drum can be stably charged. In particular, the charging device illustrated in FIG. 23 includes a spacer as the electrode supporting mechanism. Therefore, the distance between the electron discharging electrode and the opposing electrode can be easily kept constant.

The charging device illustrated in FIG. 24 has an electrode supporting mechanism which is constituted of the grid electrode and a fixing member configured to fix the electron discharging electrode and the opposing electrodes to the grid electrode. Therefore, the distance between the electron discharging electrode and the opposing electrodes can be easily controlled so as to be a predetermined distance.

The image forming apparatus (i.e., the printer) of the present invention includes an image forming device including a photoreceptor drum serving as an image bearing member, and one of the above-mentioned charging devices. The charging device is set in the printer such that the exit openings face the image forming surface of the photoreceptor drum (i.e., the electron discharging electrode and the opposing electrode are parallel to the normal direction of the photoreceptor drum).

Since the width of the charging device in the rotation direction of the photoreceptor drum depends on the distance between the electron discharging electrode and the opposing electrode, and does not depend on the surface area of the electron discharging layer. Therefore, the surface area of the electron discharging layer can be increased to enhance the charging ability of the charging device without increasing the width of the charging device in the rotation direction of the photoreceptor drum. Therefore, a miniaturized compact image forming device can be provided.

The image forming apparatus mentioned above is a monochrome printer. However, the image forming apparatus of the present invention is not limited thereto, and can be applied to multi-color (or full color) image forming apparatus.

Figure 25:
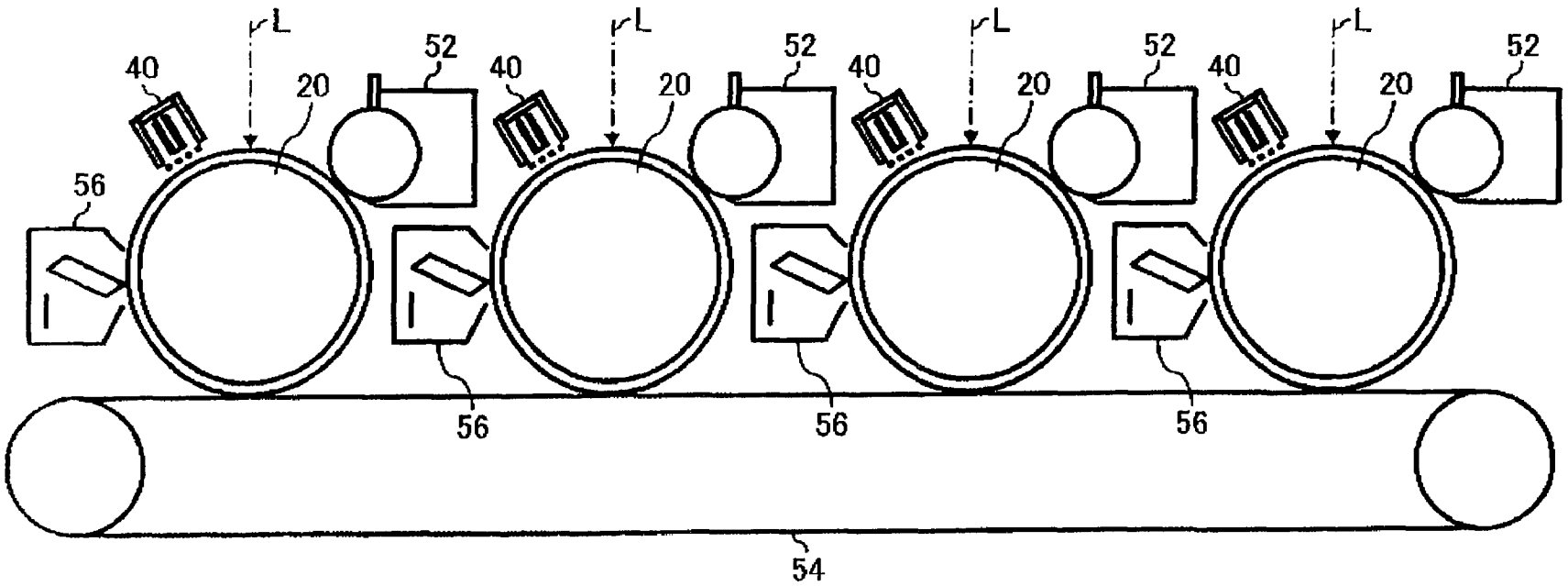
FIG. 25 is a schematic view illustrating a tandem-type full color image forming apparatus which is another embodiment of the image forming apparatus of the present invention.

FIG. 25 is a schematic view illustrating a tandem-type full color image forming apparatus according to the present invention.

Referring to FIG. 25, the image forming apparatus includes four image forming devices, each of which includes the photoreceptor drum 20, the charger 40, which is one of the charging devices mentioned above and which charges the photoreceptor drum, a developing device 52 configured to develop a latent electrostatic image with a developer including a toner to from a toner image on the photoreceptor drum 20, and a cleaning device 56 configured to clean the surface of the photoreceptor drum after the transfer process. Light (L) including image information, which is emitted by an optical image writing device (not shown), irradiates the charged photoreceptor drum to form a latent electrostatic image on the photoreceptor drum 20.

The color toner images (such as yellow, magenta, cyan and black color images) thus formed on the four photoreceptor drums 20 are then transferred to a recording material which is fed by a transfer belt 54, resulting in formation of a full color toner image on the recording material.

The charging device of the present invention can be used as not only the above-mentioned charger configured to uniformly charge an image bearing member such as photoreceptors, but also a discharger configured to discharge charges remaining on an image bearing member after a toner image is transferred onto a recording material, and a transfer charger configured to charge a transfer member to clearly transfer a toner image on an image bearing member to a recording material.

In addition, the charging device can also be used for chargers for use in various apparatuses other than image forming apparatuses.

This document claims priority and contains subject matter related to Japanese Patent Applications Nos. 2005-120490 and 2005-254373, filed on Apr. 19, 2005, and Sep. 2, 2005, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A charging device, comprising:

an electron discharging device configured to form a latent electrostatic image on an image bearing member, comprising an sp3 bonding material the surface of which has projections having sharp spindle forms; and an electroconductive portion;

wherein the sp3 bonding material is an sp3 bonding boron nitride selected from the group consisting of sp3 bonding 5H-BN materials, sp3 bonding 6H-BN materials and mixtures thereof.

2. The charging device according to claim 1, wherein a voltage is applied between the image bearing member and the electron discharging device comprising the sp3 bonding material to discharge electrons from a surface of the sp3 bonding material and the image bearing member is charged by the electrons or ions generated when the electrons are attached to air molecules.

3. The charging device according to claim 2, wherein the voltage applied between the electron discharging device comprising the sp3 bonding material and the image bearing member is not greater than a discharging limit determined by Paschen's law.

4. The charging device according to claim 1, wherein the electron discharging device comprising the sp3 bonding material is disposed opposing a surface of the image bearing member with a gap of not less than 20 μm.

5. The charging device according to claim 4, wherein the electron discharging device comprising the sp3 bonding material is disposed opposing a surface of the image bearing member with a gap of not less than 50 μm.

6. The charging device according to claim 1, wherein the electron discharging device comprising the sp3 bonding material further comprises an electroconductive member which is configured to control a voltage of a surface of the image bearing member and disposed between the electron discharging device comprising the sp3 bonding material and the image bearing member.

7. The charging device according to claim 1, wherein the electron discharging device comprising the sp3 bonding material is a thin layer having a thickness not greater than 100 μm formed on the electroconductive portion.

8. The charging device according to claim 1, wherein the electron discharging device comprising the sp3 bonding material is formed so that powder of the sp3 bonding material is fixed on the electroconductive portion by electroconductively contacting the electroconductive portion.

9. An image forming apparatus, comprising:

an image bearing member;

the charging device of claim 1 configured to charge the image bearing member to form a latent electrostatic image on the image bearing member;

a developing device configured to develop the latent electrostatic image; and a transfer device configured to transfer the developed image to a transfer material.

10. The image forming apparatus according to claim 9, wherein the charging device comprises a plurality of independent charging elements and a voltage supplying device is provided such that it is possible to independently set and apply a voltage to each of the plural independent charging units.

11. The image forming apparatus according to claim 10, wherein the voltage supplying device applies a controlled voltage so that each charging element can supply the same amount of charge to the image bearing member.

12. A process cartridge, comprising:

an image bearing member;

the charging device of claim 1; and at least one device selected from the group consisting of a developing device, a transfer device and a cleaning device, wherein the process cartridge is detachably attached to a main body of an image forming apparatus.

13. The charging device according to claim 1, wherein said spindle form have a length of about 10 μm along with a laser irradiation direction.

* * * * *